US011643231B2

(12) United States Patent
Xu

(10) Patent No.: US 11,643,231 B2
(45) Date of Patent: May 9, 2023

(54) MATERIAL FEEDING, DISTRIBUTING, AND PUSHING MECHANISM OF TYING TOOL, AUTOMATED TYING TOOL, AND AUTOMATED TYING METHOD

(71) Applicant: SHENZHEN SWIFT AUTOMATION TECHNOLOGY CO., LTD., Shenzhen (CN)

(72) Inventor: Xiuyi Xu, Shenzhen (CN)

(73) Assignee: SHENZHEN SWIFT AUTOMATION TECHNOLOGY CO., LTD., Guangdon (CN)

( * ) Notice: Subject to any disclaimer, the term of this patent is extended or adjusted under 35 U.S.C. 154(b) by 331 days.

(21) Appl. No.: 16/955,770

(22) PCT Filed: Jan. 31, 2019

(86) PCT No.: PCT/CN2019/074247
§ 371 (c)(1),
(2) Date: Aug. 5, 2020

(87) PCT Pub. No.: WO2019/149253
PCT Pub. Date: Aug. 8, 2019

(65) Prior Publication Data

US 2020/0391891 A1 Dec. 17, 2020

(30) Foreign Application Priority Data

Feb. 2, 2018 (CN) ..... 201810106643.2
Jan. 29, 2019 (CN) ..... 201910087808.0

(51) Int. Cl.
*B65B 13/02* (2006.01)
*B65B 13/18* (2006.01)
(Continued)

(52) U.S. Cl.
CPC ..... *B65B 13/027* (2013.01); *B65B 13/187* (2013.01)

(58) Field of Classification Search
CPC ..... B65B 13/027; B65B 13/187; B65B 13/16; B65B 13/18; B65B 59/003
See application file for complete search history.

(56) References Cited

U.S. PATENT DOCUMENTS 3,891,012 A * 6/1975 Bakermans ..... B65B 13/027 140/93.2
5,205,328 A * 4/1993 Johnson ..... B65B 13/027 140/93.2
(Continued)

FOREIGN PATENT DOCUMENTS

CN 106347734 1/2017
CN 206288281 1/2017
(Continued)

OTHER PUBLICATIONS

English translate (JP2007238102A), retrieved date Oct. 28, 2022 (Year: 2022).*
(Continued)

*Primary Examiner* — Matthew Katcoff
*Assistant Examiner* — Mohammed S. Alawadi
(74) *Attorney, Agent, or Firm* — PCFB LLC

(57) ABSTRACT

An automated tying tool includes slider, guide rail, first guide claw, second guide claw, frame, tensioning wheel, cutter, stepwise material feeding mechanism, and material pushing rod. First and second guide claws are mounted on frame via rotation of central pin. Cutter and tensioning wheel are mounted in frame. Guide rail is adjacent to frame. Slider engages with guide rail. An automated tying method includes: stepwise material feeding mechanism being loaded with ties, and conveying ties at fixed interval in each binding cycle; slider driving ties to slide from predetermined posi-
(Continued)

tion to binding position; tie body of ties being curled in guide slots in first and second guide claws; causing tail portion of ties to pass through a hole at head portion of ties; tensioning wheel rotating to tighten ties; and cutter cutting tightened ties. A tying tool may include a material feeding, distributing, and pushing mechanism.

19 Claims, 30 Drawing Sheets

(51) Int. Cl.
*B65B 13/16* (2006.01)
*B65B 59/00* (2006.01)

(56) References Cited

U.S. PATENT DOCUMENTS 5,560,187 A 10/1996 Nagashima et al.
5,615,538 A 4/1997 Miyashita et al.
6,039,089 A 3/2000 Kurmis
6,082,577 A * 7/2000 Coates ..... B65B 13/027 221/80

FOREIGN PATENT DOCUMENTS

CN 205971942 2/2017
JP H0285574 U 7/1990
JP H04102520 A 4/1992
JP H07187119 7/1995
JP H1063611 A 3/1998
JP 2007238102 A * 9/2007

OTHER PUBLICATIONS

Waste containers, retrieved date Oct. 29, 2022. https://grabcad.com/library/underground-waste-containers-2 (Year: 2022).*
PCT Application No. PCT/CN2019/074247, International Search Report dated May 5, 2019, 3 pp.
PCT Application No. PCT/CN2019/074247, Written Opinion dated May 5, 2019, 4 pp.

* cited by examiner

MATERIAL FEEDING, DISTRIBUTING, AND PUSHING MECHANISM OF TYING TOOL, AUTOMATED TYING TOOL, AND AUTOMATED TYING METHOD

CROSS-REFERENCE TO RELATED APPLICATIONS

The present disclosure claims the priority to the Chinese patent application with the filing number 2018101066432 filed on Feb. 2, 2018 with the Chinese Patent Office, and entitled "Automated Tying Tool", and the Chinese patent application with the filing number 2019100878080 filed on Jan. 29, 2019 with the Chinese Patent Office, and entitled "Material Feeding, Distributing and Pushing Mechanism of Tying Tool and Automated Tying Method", which are incorporated herein by reference in entirety.

TECHNICAL FIELD

The present disclosure relates to the technical field of binding equipment, in particular to a material feeding, separating and pushing mechanism of a tying tool (i.e., a mechanism for feeding, separating and pushing a material fora tying tool), an automated tying tool and an automated tying method.

BACKGROUND ART

Common plastic ties have a square head, all of existing automated tying tools realize automatic binding operation by positioning the square head of the ties. One-piece fixing ties are widely used for automobiles, trains, motorcycles and some other transportation means. The one-piece fixing tie is a combination of functions of common ties and an additional head fixing feature, and the fixing feature of the head of the tie is mainly used to be buckled on a vehicle frame or a housing of a household appliance. Common types of head feature of the one-piece fixing ties mainly include: a combination of fir-tree head with butterfly shape, or a combination of fir-tree head with wing shape, a combination of arrow with butterfly shape, or a combination of arrow with wing shape, or a flat-plate type with locking hole, etc. As the one-piece fixing ties have irregular head shapes of various types, most of the one-piece fixing ties are not suitable for feeding by adopting a vibration disc or feeding by adopting a pipe, so that the one-piece fixing tie is relatively difficult to be positioned and fed automatically in an automated tool, and all of the design concepts and methods of various automated tying machines and tools which have come into being are not suitable for automation of the one-piece fixing ties. According to the introduction from transnational companies in large-sized automobile wiring harness industry, for the past thirty years, many well-known automobile manufacturing companies and transnational companies in the automobile wiring harness industry have tried to develop an automated tying tool suitable for one-piece fixing ties by themselves or together with some well-known tool manufacturers, but their efforts have not been successful for over three decades.

SUMMARY

Objects of the present disclosure include providing an automated tying tool so as to solve the technical problems of great labor intensity and low efficiency of manual tying operation.

The present disclosure is mainly designed for automatic binding of loose-packed or interconnected one-piece fixing ties with different head shapes or ties with a label, but the present disclosure is also applicable to automatic binding operation of loose-packed or interconnected common ties with regular head shapes. In order to facilitate the description in the following, ties of different types are generally called as ties.

An automated tying tool provided in the present disclosure includes a slider, a guide rail, a first guide claw, a second guide claw, a frame, a tensioning wheel, a cutter, a stepping feeding mechanism and a material pushing rod, wherein the first guide claw and the second guide claw are mounted on the frame via rotation-center pin, the cutter and the tensioning wheel are mounted in the frame, the guide rail is adjacent to the frame, the slider cooperates with the guide rail and slides along a length direction of the guide rail, the first guide claw, the second guide claw, the slider and the guide rail are arranged to have symmetrical center planes located on a center plane of the automated tying tool, the stepping feeding mechanism is mounted on the frame or mounted on a housing of the automated tying tool, the stepping feeding mechanism is capable of loading a tie, and the tie is conveyed, in each binding cycle, to a position, where a symmetrical center plane of the tie is coincident with a center plane of the automated tying tool, according to a fixed interval, the material pushing rod is mounted on the frame or the housing of the automated tying tool, the material pushing rod pushes the tie located on the center plane of the automated tying tool to the slider to be pre-positioned, and the slider drives the tie to slide from the pre-positioning position to a binding operation position.

Optionally, the stepping feeding mechanism includes a wheel disc performing an intermittent indexing motion, configured to enable the tie to rotate for indexing feeding; alternatively, the stepping feeding mechanism includes a material shifting pin stepping translationally, configured to enable the tie to step translationally; and alternatively, the stepping feeding mechanism includes a material shifting pin swinging back and forth, configured to enable the tie to swing for stepping transportation.

In the above, all of the wheel disc performing an intermittent indexing motion, the material shifting pin stepping translationally and the material shifting pin swinging back and forth are capable of conveying, in each binding cycle, one tie to the position where the symmetrical center plane of the tie is coincident with the center plane of the automated tying tool.

Optionally, profiling recesses matching, in shape, with a head portion of the tie are provided on outer circumference of the wheel disc, the number of the profiling recesses is multiple, and all of the profiling recesses are uniformly distributed on the outer circumference of the wheel disc according to a fixed interval.

Optionally, the slider and the guide rail are both located inside the circumference of the wheel disc, and the material pushing rod is mounted outside the circumference of the wheel disc, and configured to push the tie towards the slider in a direction approaching to a center of the wheel disc.

Alternatively, the slider and the guide rail are both located outside the circumference of the wheel disc, and the material pushing rod is mounted inside the circumference of the wheel disc, and configured to push the tie towards the slider in a direction away from a center of the wheel disc.

Optionally, the slider cooperates with the guide rail, and the guide rail is configured to restrict the slider in terms of five spatial degrees of freedom, so that the slider is only capable of sliding on the guide rail.

Optionally, the slider is provided thereon with a protruding rib, configured to clamp a head portion of the tie.

Alternatively, the slider is provided thereon with a profiling recess matching, in shape, with a head portion of the tie and configured to clamp the head portion of the tie.

Optionally, the ties are interconnected ties, the automated tying tool further includes a riving knife configured to separate each tie among the interconnected ties from a tie connecting plate of the interconnected ties, and the riving knife is mounted on the slider, or the riving knife is mounted on the material pushing rod.

The riving knife is provided thereon with a protruding rib.

Optionally, the riving knife is driven by pneumatic power or electric power.

Optionally, the ties are interconnected ties, the wheel disc is provided thereon with a positioning column, the tie connecting plate of the interconnected ties is provided thereon with a positioning hole, and the positioning hole cooperates with the positioning column.

Alternatively, the wheel disc is provided thereon with a positioning hole, the tie connecting plate of the interconnected ties is provided thereon with a positioning column, and the positioning column cooperates with the positioning hole.

Optionally, the wheel disc is provided thereon with interval pins, the number of the interval pins is multiple, all of the interval pins are uniformly distributed along a circumferential direction of the wheel disc at intervals, the wheel disc is further pivoted with an indexing cam, the indexing cam has a profile abutting against an outer circumferential surface of the interval pins, and is configured to drive the wheel disc to rotate.

Alternatively, the wheel disc is provided with interval pins and interval rollers sleeved on the interval pins, all of the interval pins are uniformly distributed along a circumferential direction of the wheel disc at intervals, the wheel disc is further pivoted with an indexing cam, the indexing cam has a profile abutting against an outer circumferential surface of the interval rollers, and the indexing cam is configured to drive the wheel disc to rotate or lock the wheel disc, to realize the intermittent indexing motion of the wheel disc.

Alternatively, the circumference of the wheel disc is provided thereon with inner teeth, the gear is engaged with the inner teeth of the wheel disc so as to drive or lock the wheel disc, to realize the intermittent indexing motion of the wheel disc.

Alternatively, the circumference of the wheel disc is provided thereon with an outer tooth, the gear is engaged with the outer tooth of the wheel disc so as to drive or lock the wheel disc, to realize the intermittent indexing motion of the wheel disc.

Alternatively, the wheel disc is provided with interval pins, the number of the interval pins is multiple, all of the interval pins are distributed along the circumferential direction of the wheel disc at intervals, the automated tying tool further includes an indexing cam pivoted to the frame and a locking block elastically connected to the frame, wherein the indexing cam is configured to stir the interval pins to rotate for feeding, and the locking block tends to be clamped between two adjacent interval pins all the time, so as to lock the wheel disc.

Alternatively, ratchets are uniformly distributed on the circumference of the wheel disc, a pawl is provided to drive the wheel disc to rotate, and a locking block is provided to lock the wheel disc, to realize the intermittent indexing motion of the wheel disc.

Alternatively, the circumference of the wheel disc is provided thereon with incomplete tooth profiles and inner concave arcs that are uniformly distributed alternately, teeth of an incomplete gear are provided to be engaged with the incomplete tooth profiles of the wheel disc, to drive the wheel disc to rotate, outer convex arcs of the incomplete gear are matched with the inner concave arc of the wheel disc to lock the wheel disc, to realize the intermittent indexing motion of the wheel disc.

Alternatively, the wheel disc is provided thereon with radial grooves and inner concave arcs that are uniformly distributed alternately, a driving disc is arranged, shifting pins and outer convex arcs are mounted on the driving disc, the shifting pins on the driving disc is engaged with the grooves of the wheel disc, to drive the wheel disc to rotate, and the outer convex arcs on the driving disc are matched with the inner concave arcs of the wheel disc, to lock the wheel disc, to realize the intermittent indexing motion of the wheel disc.

Optionally, the stepping feeding mechanism includes a material shifting pin stepping translationally, the stepping feeding mechanism further includes a material guiding plate, a feeding cylinder and a cylinder of material shifting pin, the material guiding plate is fixedly provided on the frame, and configured to guide the interconnected ties, the feeding cylinder is mounted on the frame, the cylinder of material shifting pin is mounted at a power output end of the feeding cylinder, and the material shifting pin is fixedly provided at the power output end of the cylinder of material shifting pin;

the feeding cylinder is configured to linearly advance the cylinder of material shifting pin by one fixed interval, and the cylinder of material shifting pin is configured to insert the material shifting pin into the positioning hole in the tie connecting plate of the interconnected ties, so as to drive the interconnected ties to step translationally.

Optionally, the automated tying tool further includes a material pressing assembly configured to press the tie connecting plate on the material guiding plate; and the material pressing assembly is mounted on the frame.

Optionally, the material pressing assembly includes a material pressing plate and a material pressing wheel pivoted to the material pressing plate, a spring is connected between the material pressing plate and the frame, and under the effect of the spring, the material pressing wheel presses the tie connecting plate on the material guiding plate, or the material pressing wheel presses the tie connecting plate on the wheel disc.

Optionally, the stepping feeding mechanism includes a material shifting pin swinging back and forth, the stepping feeding mechanism further includes a material guiding plate, a swinging bracket and a cylinder of material shifting pin, the material guiding plate is fixedly provided on the frame, and configured to guide the interconnected ties, the swinging bracket is pivoted to the frame, and is capable of swinging back and forth along a material guiding direction, the cylinder of material shifting pin is mounted on the swinging bracket, and the material shifting pin is fixedly provided to a power output end of the cylinder of material shifting pin; and the swinging bracket is configured to swing by one fixed interval, and the cylinder of material shifting pin is configured to insert the material shifting pin into the positioning hole in the tie connecting plate of the interconnected ties, so as to drive the interconnected ties to swing for feeding.

Optionally, the stepping feeding mechanism, the first guide claw, the slider, the material pushing rod and the cutter are driven by pneumatic power or electric power.

Optionally, the second guide claw is driven by pneumatic power or electric power, or driven by a manual trigger through a connecting rod.

Optionally, the automated tying tool further includes a waste box mounted on the frame and configured to collect cut waste.

Optionally, a discharging port is provided at a bottom portion of the waste box, a door panel of waste box is arranged at the discharging port, and the door panel of waste box is pivoted to a box body of the waste box through a door panel rotating shaft.

Objects of the present disclosure further include providing an automated tying method, so as to solve the technical problem of low efficiency of manual tying operation.

The automated tying method provided in the present disclosure is used to bind loose-packed ties, and includes following steps:

S1: placing a tie on a stepping feeding mechanism, which acts to convey the tie to a position where a symmetrical center plane of the tie is coplanar with a center plane of the automated tying tool;

S2: enabling a material pushing rod to act to push the tie onto the slider to be pre-positioned;

S3: enabling the slider to move to drive the tie to slide from the pre-positioning position in the step S2 to a binding operation position, wherein in a sliding process of the slider, a tie body of the tie is curled in guide slots in a first guide claw and a second guide claw, and enabling the first guide claw to rotate to make a tail portion of the tie pass through a hole on a head portion of the tie;

S4: enabling a tensioning wheel to rotate to tighten the tie, and cutting off the tensioned tie with a cutter; and S5: allowing a head portion of the tie to exit from the slider, wherein the slider returns back along the guide rail from the binding position to the pre-positioning position.

Objects of the present disclosure further include providing another automated tying method, so as to solve the technical problems of low efficiency of manual tying operation and inconvenient binding of interconnected ties.

The automated tying method provided in the present disclosure is used to bind interconnected ties, and includes following steps:

S10: placing a tie on a stepping feeding mechanism, which acts to convey the tie to a position where a symmetrical center plane of the tie is coplanar with a center plane of the automated tying tool;

S20: enabling the riving knife to act to separate the tie moving in place in step S10 from a tie connecting plate of the interconnected ties;

S30: enabling the material pushing rod to act to push the tie separated from the tie connecting plate in the step S20 onto the slider to be pre-positioned;

S40: enabling the slider to move to drive the tie to slide from the pre-positioning position in the step S30 to a binding operation position, wherein in sliding process of the slider, a tie body of the tie is curled in guide slots in first guide claw and the second guide claw, and enabling the first guide claw to rotate to make the tail portion of the tie pass through a hole on the head portion of the tie;

S50: enabling a tensioning wheel to rotate to tighten the tie, and cutting off the tensioned tie with a cutter; and S60: allowing a head portion of the tie to exit from the slider, wherein slider returns back along the guide rail from the binding position to the pre-positioning position.

Beneficial effects of the present disclosure are as follows:

By providing the automated tying tool, during the binding operation, the ties are placed on the stepping feeding mechanism, and using the intermittent feeding characteristic of the stepping feeding mechanism, the ties are conveyed one by one to the position where the symmetrical center plane of the tie is coplanar with a center plane of the automated tying tool; then the material pushing rod acts to push the tie onto the slider to be pre-positioned; subsequently, the slider moves to drive the tie to slide from the pre-positioning position to the binding operation position, wherein in the sliding process of the slider, the tie body of the tie is curled in the guide slots in the first guide claw and the second guide claw, and the first guide claw rotates to make the tail portion of the tie pass through the hole on the head portion of the tie; finally, the tensioning wheel rotates to tighten the tie, and the tensioned tie is cut off with the cutter. When the interconnected ties need to be used for the binding operation, the riving knife also can be provided in the automated tying tool, so as to separate the tie from the tie connecting plate before the material pushing rod acts, and further subsequent binding operation is realized.

Objects of the present disclosure further include providing a material feeding, separating and pushing mechanism of a tying tool, so as to solve the technical problems of low efficiency of manual tying operation and inconvenient binding of interconnected ties.

The material feeding, separating and pushing mechanism of a tying tool provided in the present disclosure includes an intermittent indexing mechanism, a material separating mechanism, a material pushing mechanism, and a slider mechanism; sequentially, the intermittent indexing mechanism conveys one tie to an operation position of the material separating mechanism each time, the material separating mechanism separates the tie from the tie connecting plate of the interconnected ties, the material pushing mechanism pushes the separated tie into the slider to be positioned; the slider mechanism slides the tie from the pre-positioning position to the binding operation position; all of the intermittent indexing mechanism, the material separating mechanism, the material pushing mechanism, and the slider mechanism are driven by electric power, controlled by a controller to act in sequence according to temporal logic, and the intermittent indexing mechanism, the material separating mechanism, and the material pushing mechanism are driven by a motor to act according to a time sequence.

The material feeding, separating and pushing mechanism of a tying tool, the automated tying tool and the automated tying method provided in the present disclosure realize the automatic binding, overcome the drawback of great labor intensity and low binding efficiency of the manual binding operation, moreover, the automated tying tool not only is applicable to automatic binding operation of loose-packed or interconnected one-piece fixing ties with irregular head shapes, but also is applicable to automatic binding operation of loose-packed or interconnected common nylon ties with a regular head shape, thus having relatively high degree of universalization, and bringing great convenience to the binding operation.

BRIEF DESCRIPTION OF DRAWINGS

In the above, FIG. 1-FIG. 32 mainly show the design solution in which the slider, the first guide claw, the second guide claw, the tensioning wheel, the cutter, the stepping feeding mechanism, the riving knife and the material pushing rod are driven electrically or pneumatically; and FIG. 33-FIG. 56 mainly show the design solution in which the slider, the first guide claw, the second guide claw, the tensioning wheel, the cutter, the stepping feeding mechanism (intermittent indexing mechanism), the riving knife and the material pushing rod are driven in an all-electric manner.

Figure 1:
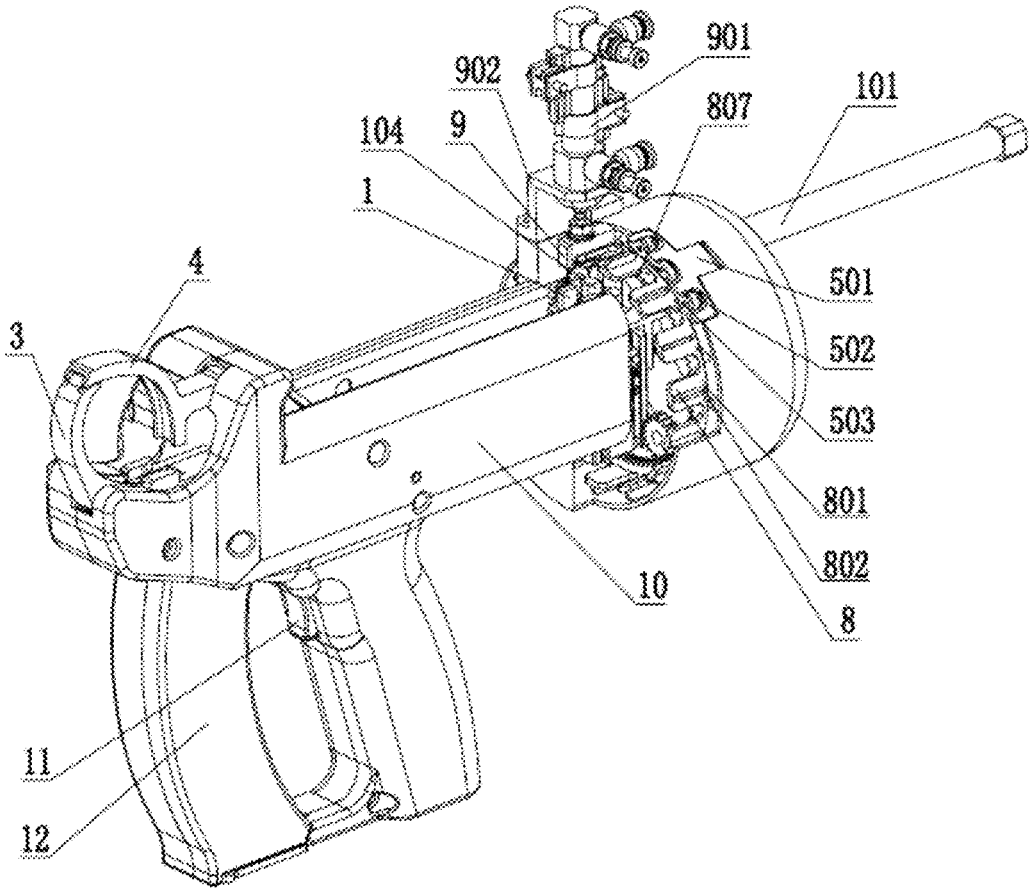
FIG. 1 is an isometric diagram of an automated tying tool provided in an embodiment of the present disclosure when being applied to interconnected ties.
Figure 2:
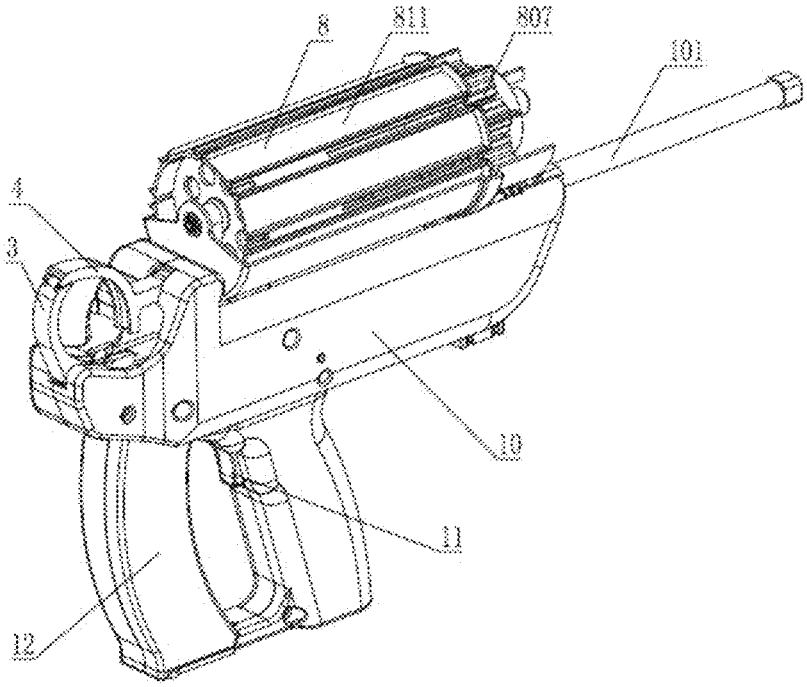
FIG. 2 is an isometric diagram of an automated tying tool provided in an embodiment of the present disclosure when being applied to loose-packed or interconnected ties.
Figure 3:
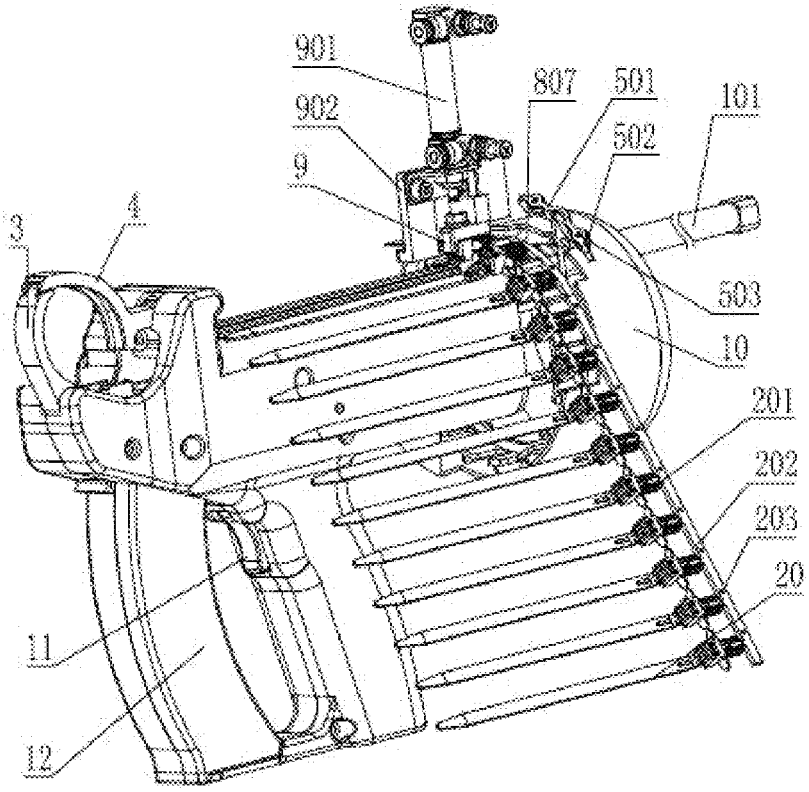
FIG. 3 is an isometric diagram of an automated tying tool provided in an embodiment of the present disclosure when being applied to interconnected ties, wherein there are ties, a material pressing plate is opened, a slider and a guide rail are located inside the circumference of a wheel disc, and a material pushing rod is located above the wheel disc.
Figure 4:
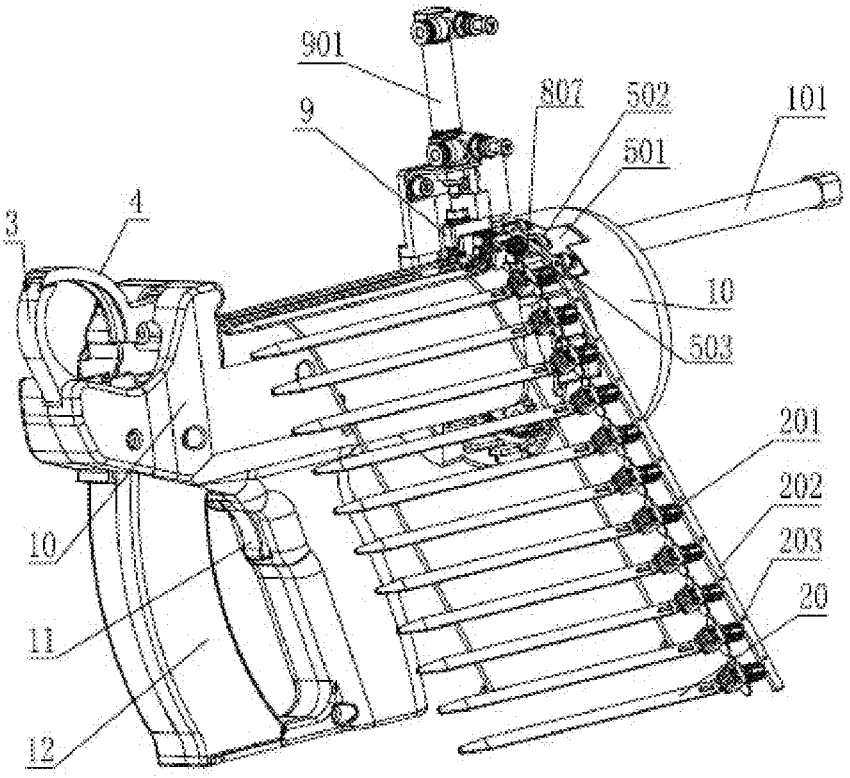
FIG. 4 is an isometric diagram of an automated tying tool provided in an embodiment of the present disclosure when being applied to interconnected ties, wherein there are ties, a material pressing plate is pressed down, a slider and a guide rail are located inside the circumference of a wheel disc, and a material pushing rod is located above the wheel disc.
Figure 5:
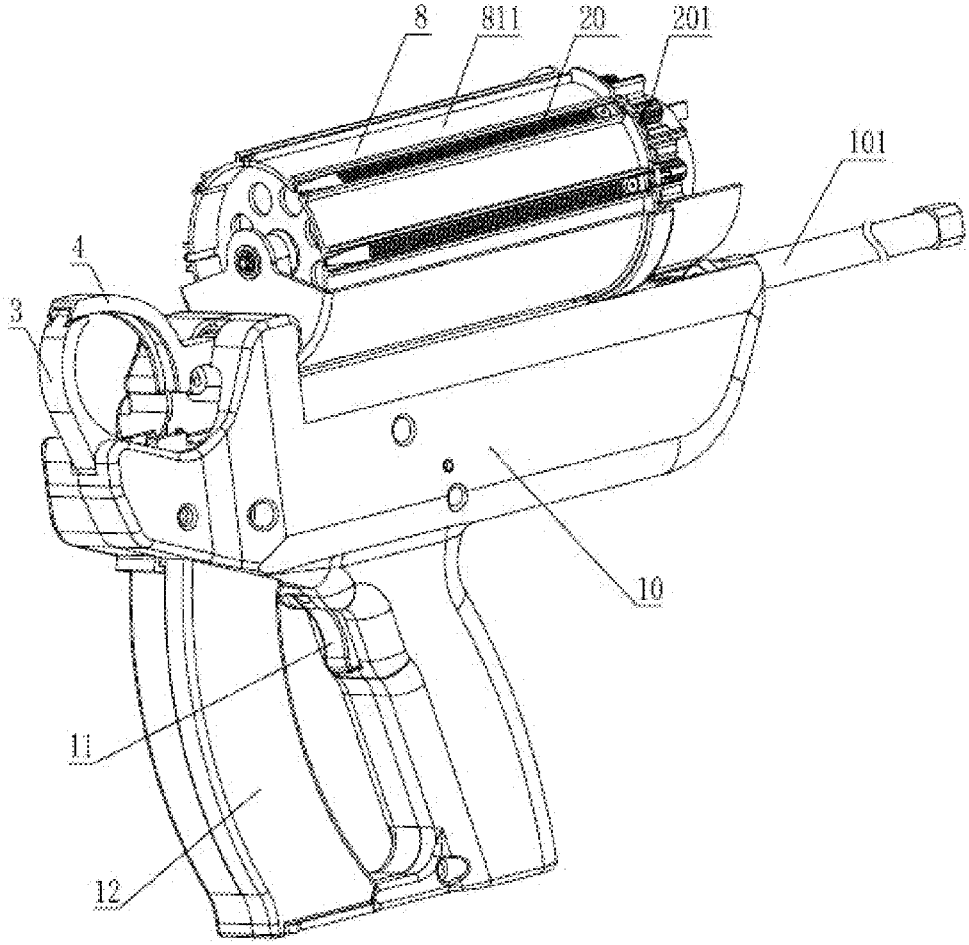
FIG. 5 is an isometric diagram of an automated tying tool provided in an embodiment of the present disclosure when being applied to loose-packed or interconnected ties, wherein there are ties, a wheel disc is located above a slider and a guide rail, and a material pushing rod is located inside circumference of the wheel disc.
Figure 6:
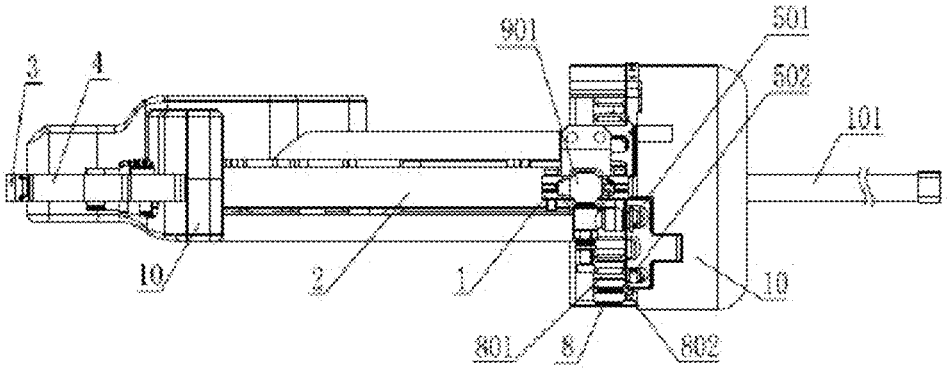
FIG. 6 is a top view corresponding to FIG. 7.
Figure 7:
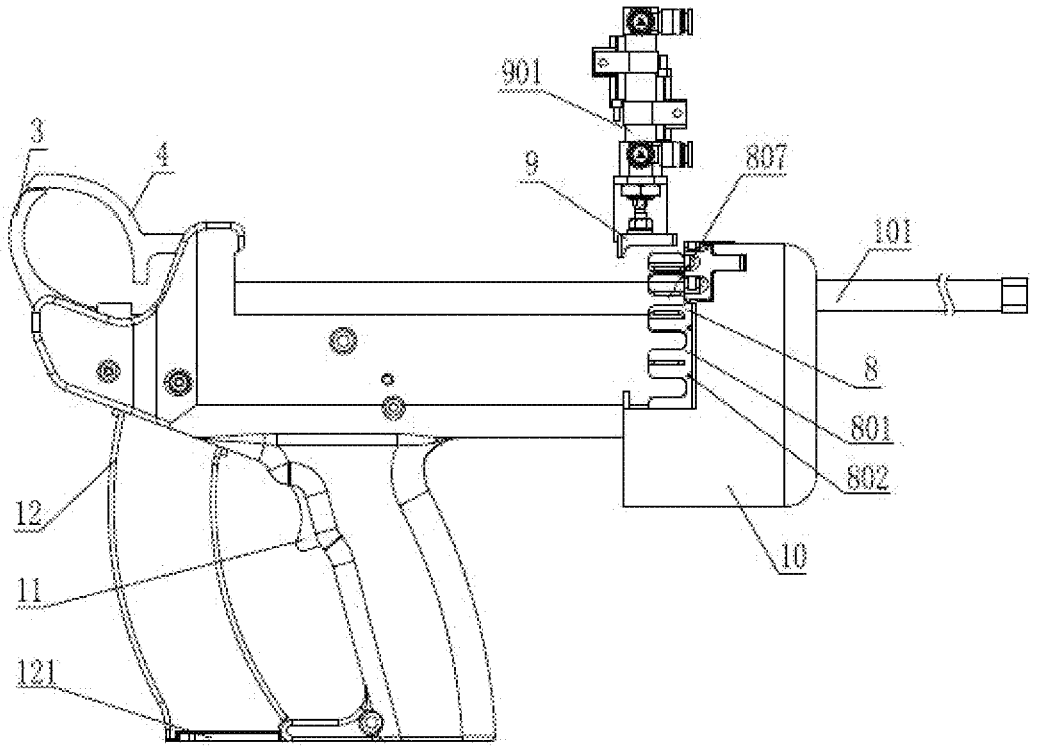
FIG. 7 is a front view of an automated tying tool provided in the present disclosure, wherein a wheel disc is adopted as a stepping feeding mechanism, a slider and a guide rail are located inside circumference of the wheel disc, and the material pushing rod is located above the wheel disc.

In the drawings, the A-A section, E-E section, F-F section, and G-G section are center planes of the automated tying tool; and in the drawings, the A-A section, E-E section, F-F section, and G-G section are also symmetrical center planes of the tie that has been pre-positioned.

Reference signs: 000. controller; 001. wire; 1. slider; 101. slider cylinder; 102. cylinder fixing frame; 103. connecting sleeve; 104. protruding rib; 100. motor; 11. trigger; 110. reduction gearbox; 111. swinging arm; 112. pin shaft; 113. connecting rod; 114. pin shaft; 117. trigger reset spring; 118. trigger center shaft; 119. reset spring; 2. guide rail; 20. tie; 201. head portion of tie; 202. tie connecting plate; 203. positioning hole; 3. first guide claw; 31. center shaft of first guide claw; 32. pin shaft; 33. connecting rod; 34. center shaft of connecting rod; 35. pin shaft; 36. driven connecting rod; 37. center shaft of driven connecting rod; 38. cam of first guide claw; 30. riving knife; 301. cylinder of riving knife; 302. ejector pin of riving knife; 303. toggle mechanism; 304. pin shaft; 305. connecting rod of ejector pin of riving knife; 307. cam roller; 308. cam of riving knife; 309. reset spring of ejector pin of riving knife; 31. rotating shaft of first guide claw; 4. second guide claw; 41. center shaft of second guide claw; 42. pin shaft; 43. connecting rod of second guide claw; 44. center shaft of connecting rod; 45. pin shaft; 46. roller; 47. cam of second guide claw; 5. frame; 501. material pressing plate; 502. material pressing wheel; 503. shaft of material pressing wheel; 6. tensioning wheel; 600. motor; 610. reduction gearbox; 620. period control gear; 621. sensing portion; 622. sensor; 630. tensioning gear; 7. cutter; 8. stepping feeding mechanism; 800. motor; 801. wheel disc; 802. positioning column; 803. interval roller; 804. indexing cam; 805. cam shaft; 806. centering wheel; 807. profiling recess; 808. interval pin; 809. locking block; 810. incomplete gear; 811. gear; 812. gear shaft; 813. gear box; 820. gear; 814. pin shaft; 815. spring; 821. material guiding plate; 822. feeding cylinder bracket; 823. feeding cylinder; 824. material shifting cylinder bracket; 825. cylinder of material shifting pin; 826. material shifting pin; 834. swinging bracket; 837. rotating shaft of swinging bracket; 9. material pushing rod; 901. material pushing cylinder; 902. material pushing cylinder bracket; 903. pin shaft; 904. connecting rod of material pushing rod; 905. center shaft of connecting rod; 906. cam roller; 907. cam shaft; 908. cam of material pushing rod; 909. reset spring of material pushing rod; 10. housing; 12. waste box; 121. door panel of waste box; 122. rotating shaft of door panel.

DETAILED DESCRIPTION OF EMBODIMENTS

Below the present disclosure is further described in combination with accompanying drawings and specific embodiments.

Figure 8:
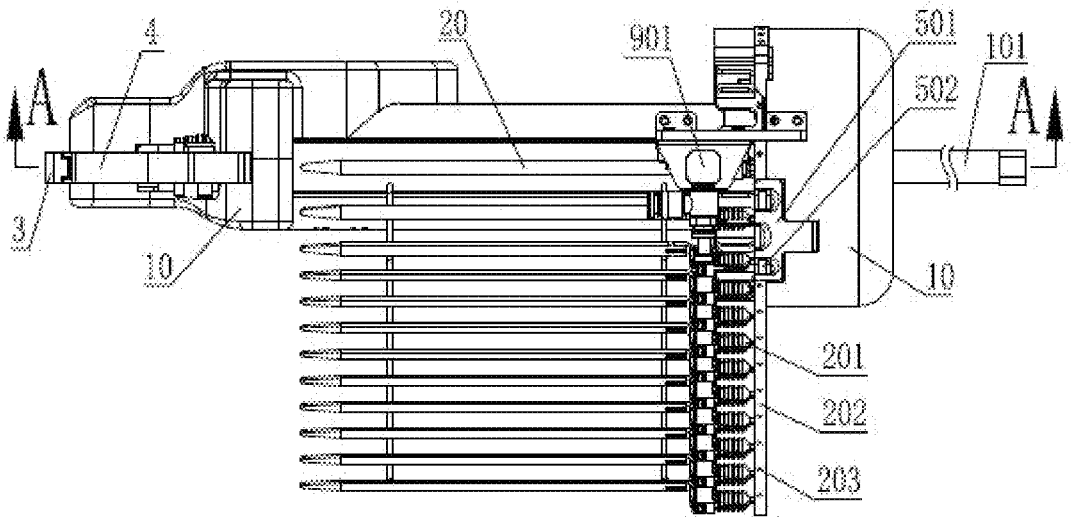
FIG. 8 is a top view corresponding to FIG. 9.
Figure 9:
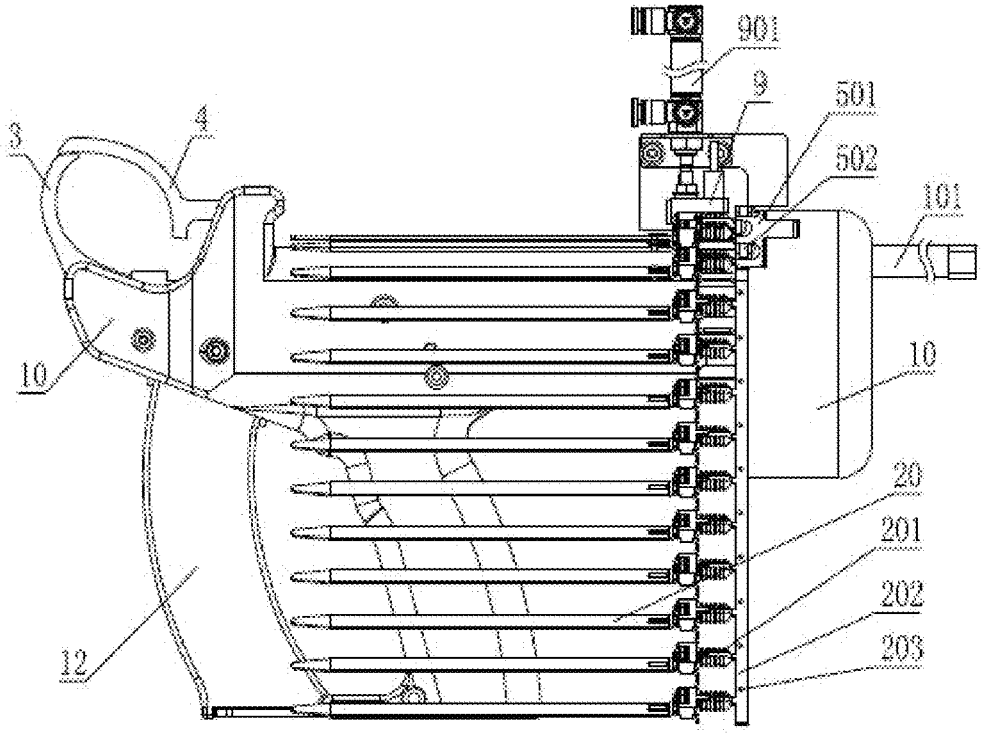
FIG. 9 is a front view of an automated tying tool provided in the present disclosure, wherein a wheel disc is adopted as a stepping feeding mechanism, a slider and a guide rail are located inside circumference of the wheel disc, the material pushing rod is located above the wheel disc, and there are ties.
Figure 25:
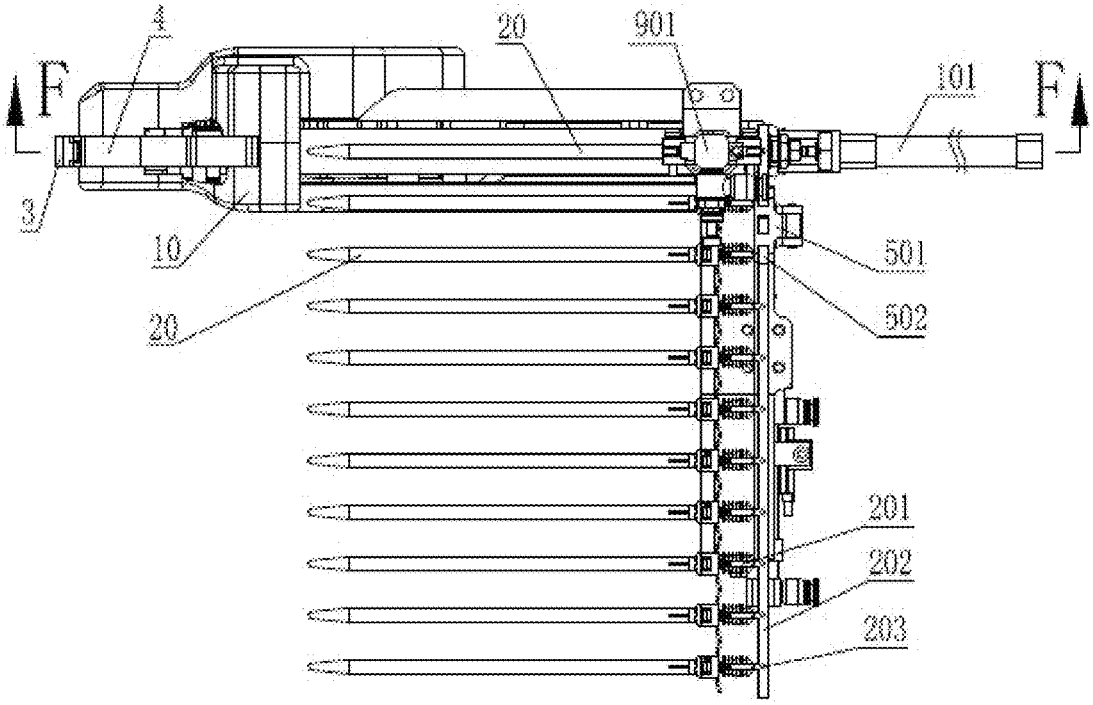
FIG. 25 is a top view corresponding to FIG. 26, wherein a feeding mechanism stepping translationally is adopted, which is applied to interconnected ties.
Figure 26:
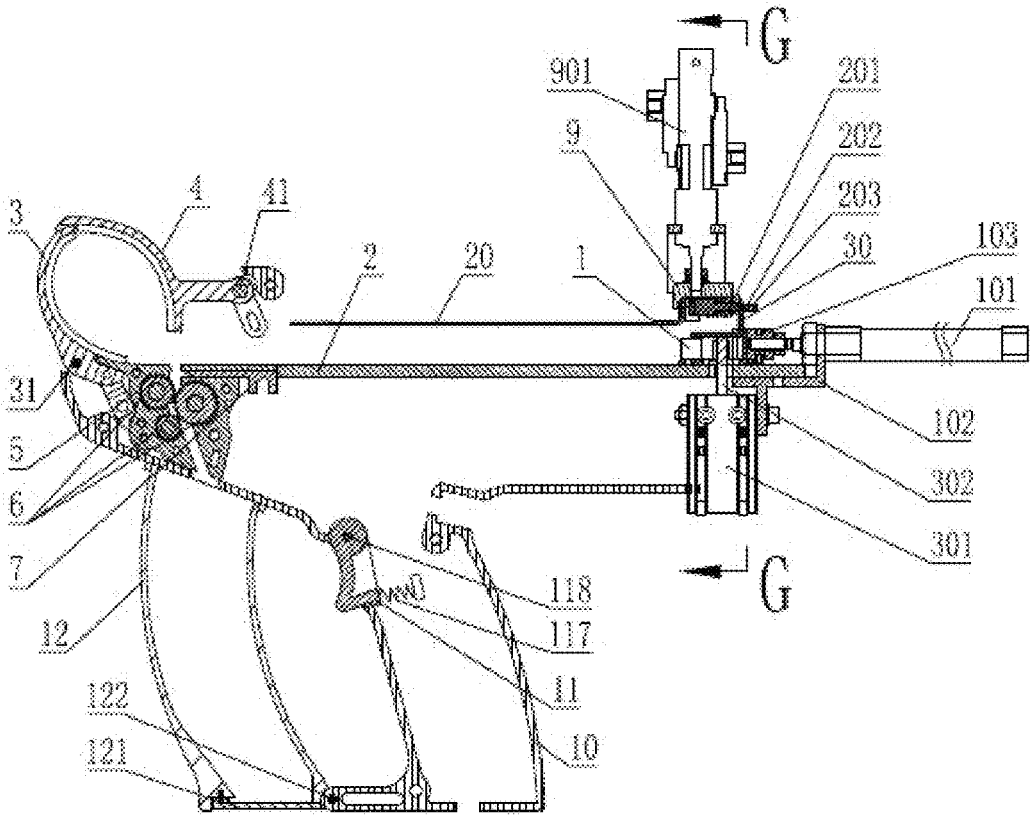
FIG. 26 is a front view of an automated tying tool provided in an embodiment of the present disclosure, which is corresponding to a sectional view taken along line F-F in FIG. 25.
Figure 27:
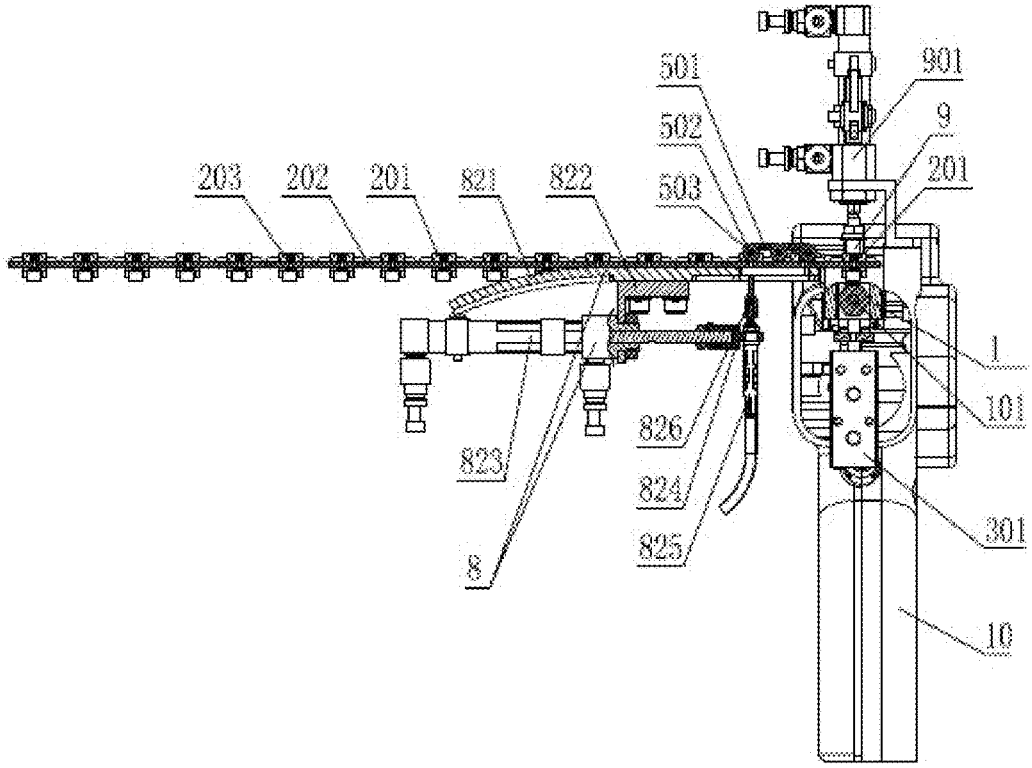
FIG. 27 is a sectional view taken along line G-G corresponding to FIG. 26, wherein a feeding mechanism stepping translationally is adopted, and a material shifting pin is in a retraction state.
Figure 28:
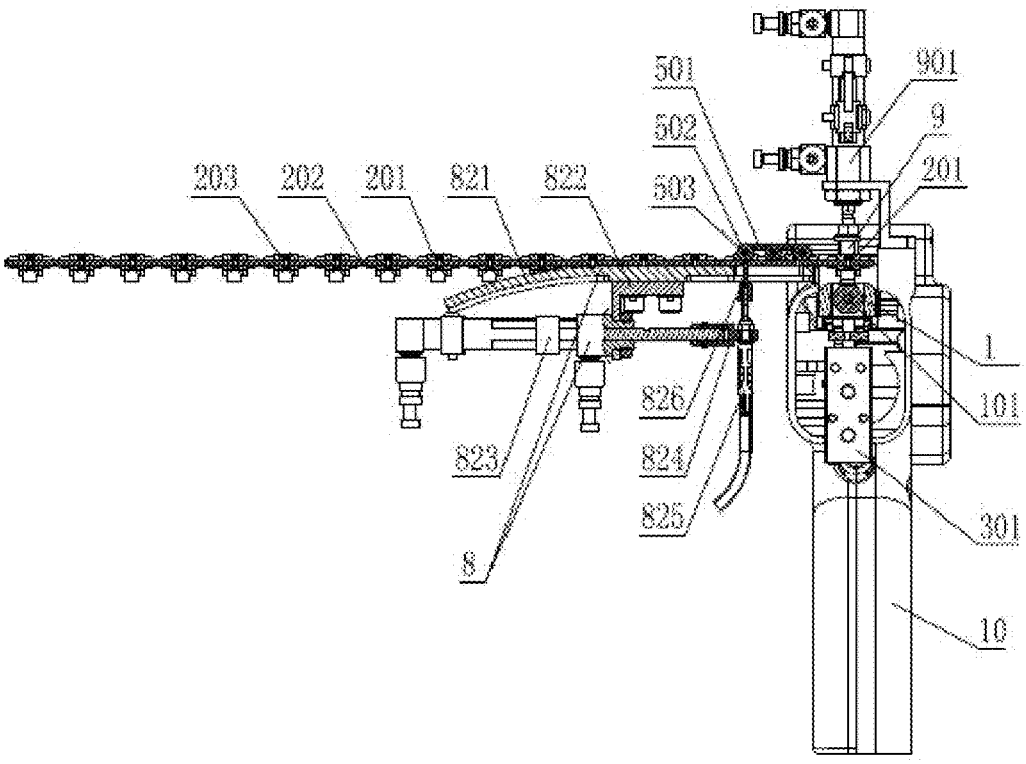
FIG. 28 is a sectional view taken along line G-G corresponding to FIG. 26, wherein a feeding mechanism stepping translationally is adopted, and a material shifting pin is inserted into a positioning hole on a connecting plate of the interconnected ties.
Figure 29:
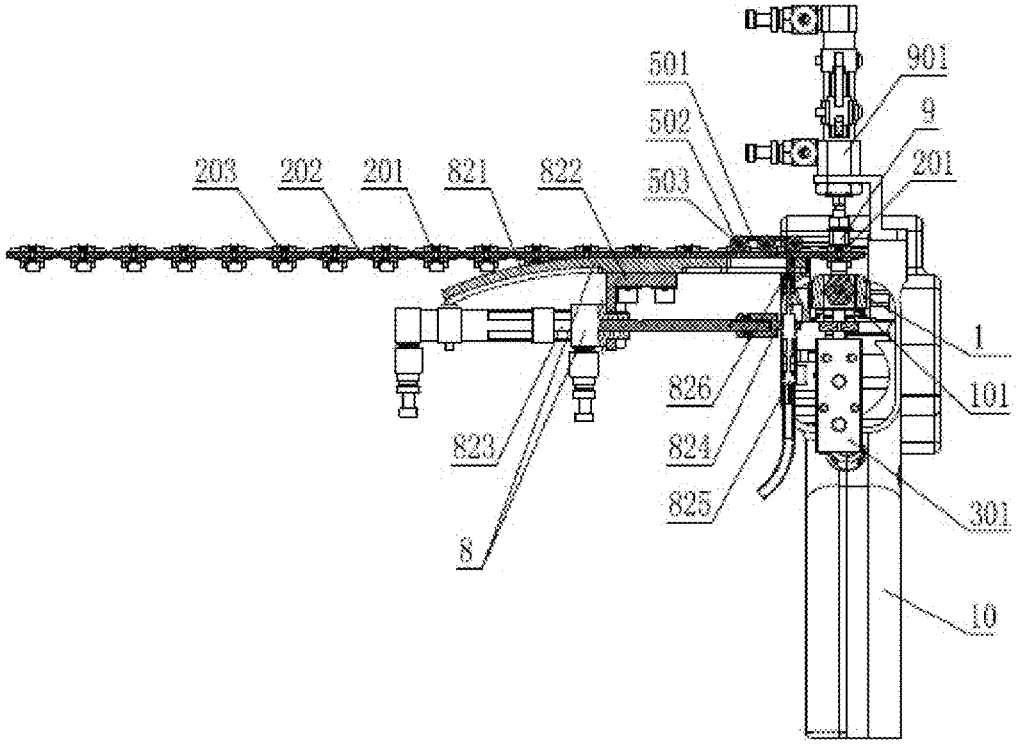
FIG. 29 is a sectional view taken along line G-G corresponding to FIG. 26, wherein a feeding mechanism stepping translationally is adopted, and a material shifting pin makes the interconnected ties move one interval.

As shown in FIG. 1, FIG. 3, FIG. 4, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19 and FIG. 20, the present embodiment provides an automated tying tool, including: a slider 1, a guide rail 2, a first guide claw 3, a second guide claw 4, a frame 5, a tensioning wheel 6, a cutter 7, a stepping feeding mechanism 8 and a material pushing rod 9, wherein the first guide claw 3 and the second guide claw 4 are mounted on the frame 5 via rotation-center pin, the cutter 7 and the tensioning wheel 6 are mounted in the frame 5, the guide rail 2 is tightly fixed on the frame 5, the slider 1 cooperates with the guide rail 2 and slides along a length direction of the guide rail 2, except for sliding along the length direction of the guide rail 2, other five spatial degrees of freedom of the slider 1 are limited by the guide rail 2, and symmetrical center planes of the first guide claw 3, the second guide claw 4, the slider 1 and the guide rail 2 are in coplanar arrangement with the center plane of the automated tying tool, wherein the A-A section shown in FIG. 8 and the F-F section shown in FIG. 25 are center planes of the automated tying tool.

As shown in FIG. 10, FIG. 12, FIG. 13, FIG. 14, FIG. 15, and FIG. 16, a cylinder fixing frame 102 is mounted on the frame 5, a cylinder barrel of the slider cylinder 101 is mounted on the cylinder fixing frame 102, a piston rod of the slider cylinder 101 is connected to the slider 1 through a connecting sleeve 103, the slider cylinder 101 drives the slider 1 to slide on the guide rail 2, the slider 1 is provided thereon with a guide slot in a vertical direction, a riving knife 30 is mounted on the slider 1 and can slide in the guide slot in the vertical direction of the slider 1, that is, the riving knife 30 slides up and down in the slider 1, and the riving knife 30 slides along the length direction of the guide rail 2 along with the slider 1; the cylinder of riving knife 301 is mounted on the cylinder fixing frame 102 through the cylinder barrel thereof, an action rod of the cylinder of riving knife 301 serves as an ejector pin of riving knife 302, and when extending out, a piston rod of the cylinder of riving knife 301 pushes the riving knife 30 upwards to separate the tie 20 from the tie connecting plate 202, so as to realize material separating. (Or the riving knife 30 is mounted on the material pushing rod 9 and slides up and down along with the material pushing rod 9; and for loose-packed ties, no riving knife 30 needs to be mounted).

Please continue to refer to FIG. 1, FIG. 3, FIG. 4 and FIG. 6 to FIG. 20, specifically, the stepping feeding mechanism 8 is a wheel disc 801 capable of performing an intermittent indexing motion, the wheel disc 801 is mounted on the frame 5 or mounted on a housing 10 of the automated tying tool through at least three centering wheels 806 or bearings, profiling recesses 807 matching with the shape of a head portion of the tie 20 are uniformly distributed on circumference of the wheel disc 801, and each profiling recess 807 is loaded with one tie. When ties for binding are interconnected ties, the wheel disc 801 is provided thereon with a positioning column 802, and meanwhile, the tie connecting plate 202 of the interconnected ties is provided with a positioning hole 203, wherein the positioning hole 203 cooperates with the positioning column 802, so that the positioning column 802 can be inserted into the positioning hole 203. A material pressing plate 501 and a material pressing wheel 502 press the tie connecting plate 202 of the interconnected ties on a material guiding plate 821 under the action of a spring (the spring is not shown), the wheel disc 801 conveys one tie 20 to a position, where the symmetrical center plane of the tie and the center plane of the automated tying tool are coplanar, according to a fixed interval in each binding cycle, the ejector pin of riving knife 302 pushes out the riving knife 30 under the action of the cylinder of riving knife 301, the riving knife 30 separates the tie 20 from the tie connecting plate 202, the material pushing rod 9 is fixedly mounted at an end portion of an action rod of a material pushing cylinder 901, a cylinder barrel of the material pushing cylinder 901 is mounted on a material pushing cylinder bracket 902, the material pushing cylinder bracket 902 is fixedly mounted on the frame 5 or the housing 10, the slider 1 cooperates with the guide rail 2, the guide rail 2 limits five spatial degrees of freedom of the slider 1, the slider 1 can only slide on the guide rail 2, and a protruding rib 104 is designed on the slider 1 for clamping the head portion of the tie 20; and the material pushing rod 9 pushes the separated head portion of tie 201 onto the slider 1 to be pre-positioned.

Please continue to refer to FIG. 13-FIG. 17, after the head portion of tie 201 is pushed onto the slider 1 to be pre-positioned, the material pushing rod 9 is retracted upwards to an upper end point, the slider 1 driven by the slider cylinder 101 drives the tie 20 to slide from a right end to a left end of the guide rail 2, that is, to slide from the pre-positioning position to a binding position of the tie 20. In the sliding process of the slider 1, a tie body of the tie 20 is curled in the guide slots in the first guide claw 3 and the second guide claw 4, the first guide claw 3 rotates around a rotating shaft of the first guide claw 31 to make the tail portion of the tie 20 pass through a hole in the head portion of tie 201, the tensioning wheel 6 rotates to tighten the tie 20, the cutter 7 cuts off the tightened tie 20, and after the head portion of the tie 20 exits from the slider 1, the slider 1 is retracted to the pre-positioning position of the tie to prepare for the next binding cycle.

It needs to be noted that in the present embodiment, the automated tying tool may be in the above structural form in which the positioning column 802 is provided on the wheel disc 801 and the positioning hole 203 is provided on the tie connecting plate 202, but is not limited thereto, while other arrangement forms may also be adopted, for example, the positioning hole is provided on the wheel disc 801 and the positioning column is provided on the tie connecting plate 202, as long as the tie connecting plate 202 can be positioned on the wheel disc 801 through such an arrangement form.

It further should be noted that in the present embodiment, "symmetrical center planes of the first guide claw 3, the second guide claw 4, the slider 1 and guide rail 2 are coplanarly or coincidently arranged on the center plane of the automated tying tool" means that the symmetrical center planes of the first guide claw 3, the second guide claw 4, the slider 1 and the guide rail 2 are arranged coincidently, and the coincident plane is superposed with the center plane of the automated tying tool (the A-A section in FIG. 8 and the F-F section in FIG. 25 are the center plane of the automated tying tool), that is to say, when slider 1 drives the tie 20 to slide from right to left, when moving to the position of the first guide claw 3, the tie 20 can curl in accordance with the radian of a bottom surface of the guide slot of the first guide claw 3, and when moving continuously, the tie 20 can curl in accordance with the radian of a bottom surface of the guide slot of the second guide claw 4, and finally, the binding operation is realized.

In addition, in the present embodiment, it may be the above-mentioned structural form that the protruding rib is provided on the slider 1 so as to position the head portion of the tie 20, but is not limited to this, while other arrangement forms may also be adopted, for example, a profiling recess 807 matching with the shape of the head portion of the tie 20 is provided on the slider 1, as long as the head portion of the tie 20 can be positioned through such structural form.

Figure 17:
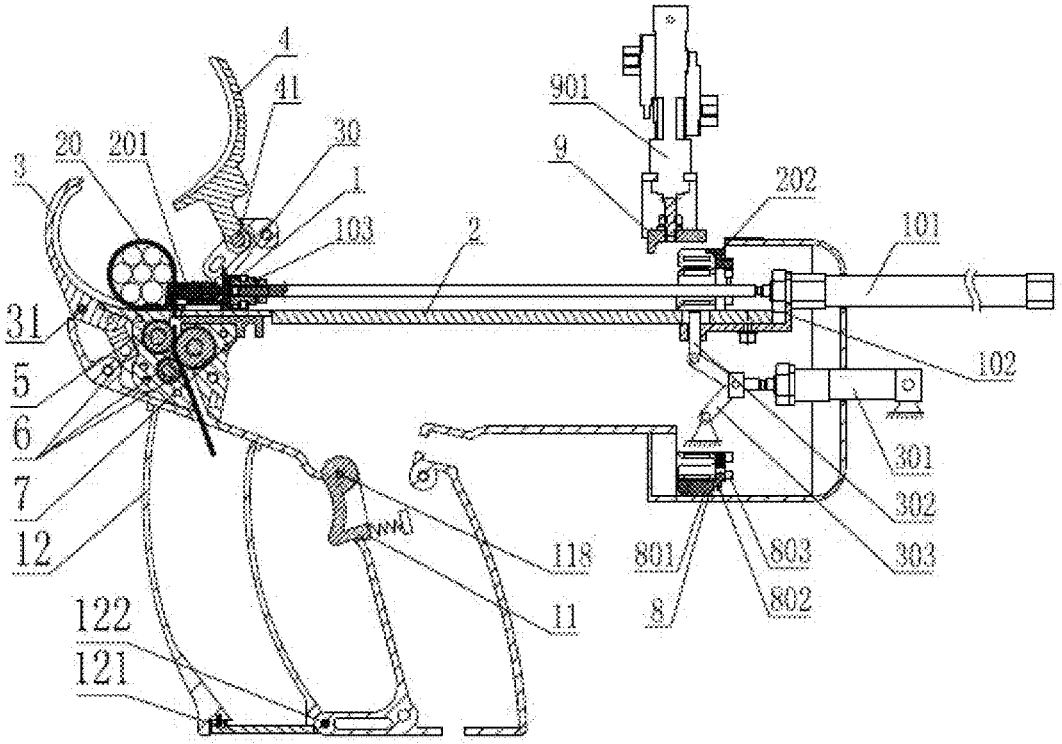
FIG. 17 is a sectional view taken along line A-A corresponding to FIG. 8, wherein the riving knife is driven through a combination of a toggle mechanism and a cylinder.
Figure 18:
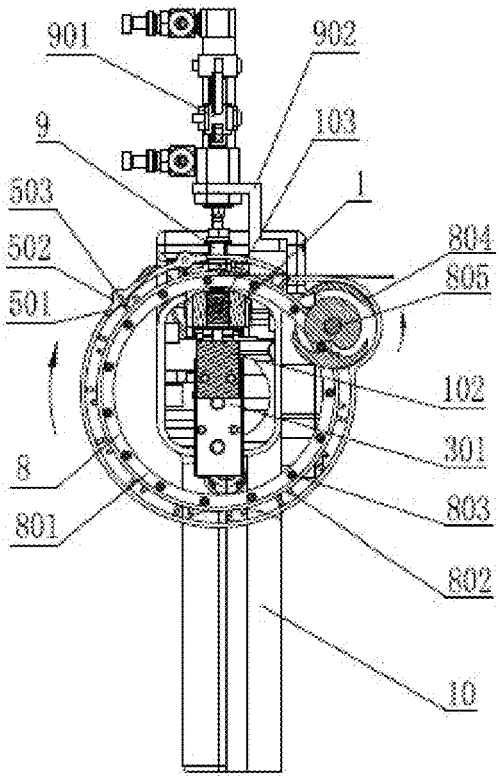
FIG. 18 is an enlarged sectional view taken along line C-C corresponding to FIG. 15, wherein an indexing cam drives the wheel disc to rotate.
Figure 19:
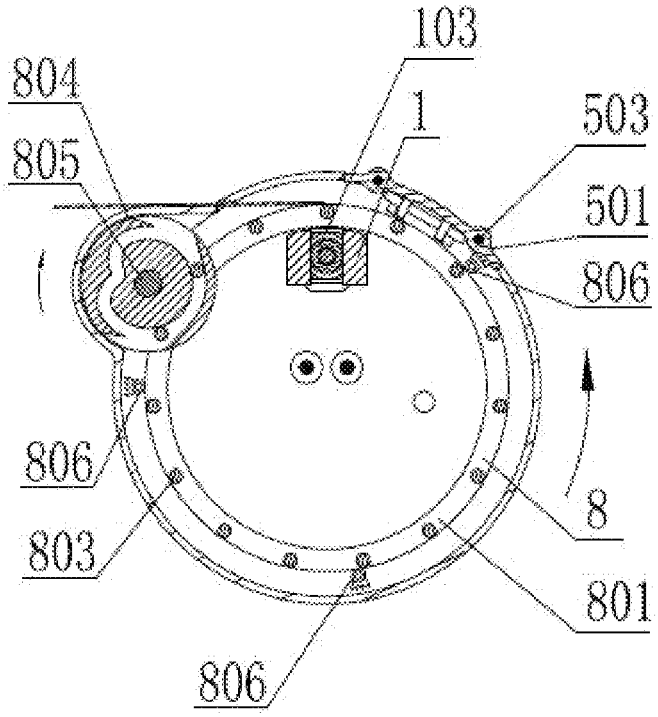
FIG. 19 is an enlarged sectional view taken along line D-D corresponding to FIG. 16, wherein the indexing cam locks the wheel disc.
Figure 20:
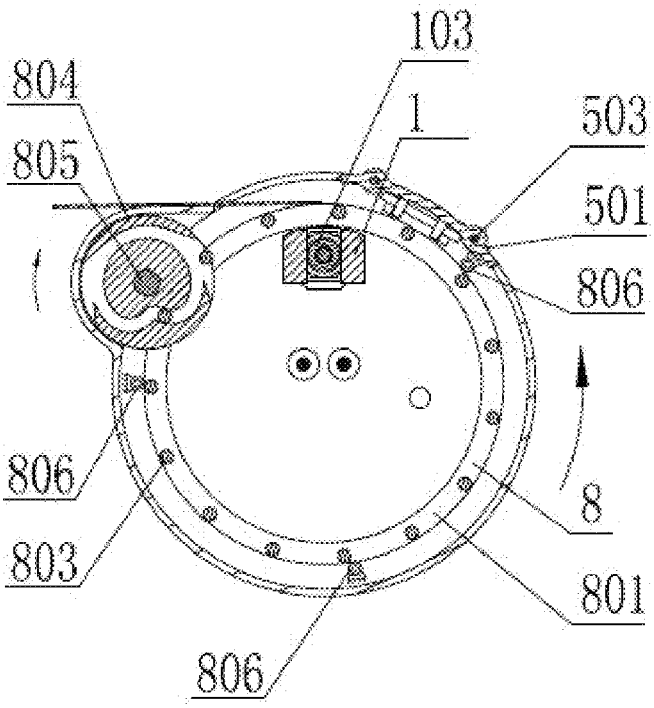
FIG. 20 is an enlarged sectional view taken along line D-D corresponding to FIG. 16, wherein the indexing cam drives the wheel disc to rotate.
Figure 21:
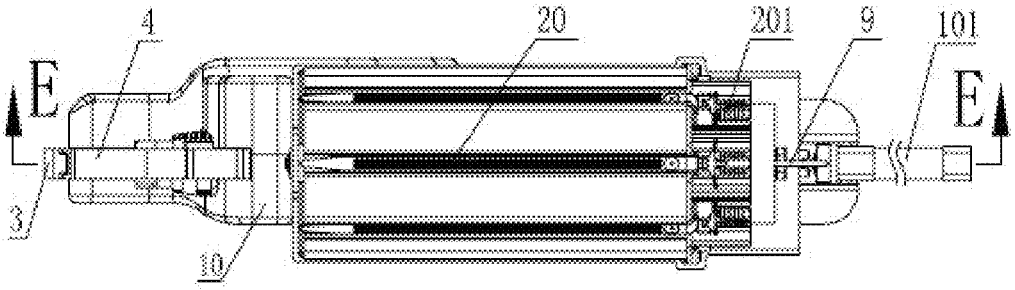
FIG. 21 is a top view corresponding to FIG. 22.
Figure 22:
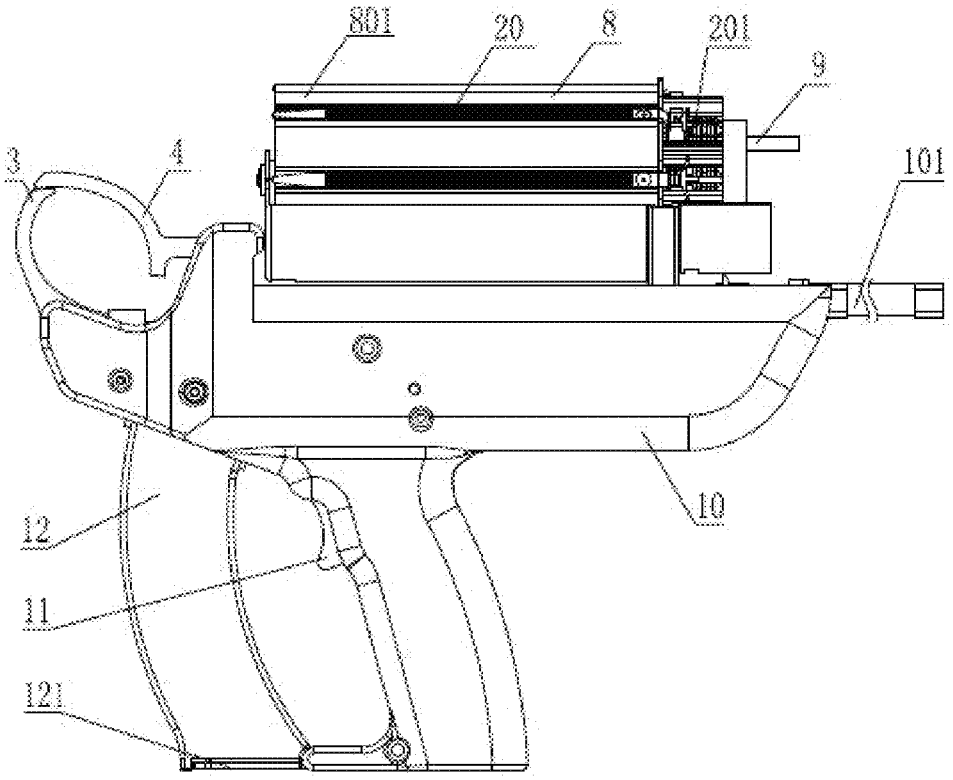
FIG. 22 is a front view of an automated tying tool provided in an embodiment of the present disclosure, wherein a wheel disc is located above a slider and a guide rail, and a material pushing rod is located inside circumference of the wheel disc.

Please continue to refer to FIG. 17, in the present embodiment, a toggle mechanism 303 further can be arranged between the piston rod of the cylinder of riving knife 301 and the riving knife 30. With such arrangement, the cutting force of the riving knife 30 is increased, so that each tie 20 among the interconnected ties can be reliably and quickly cut off from the tie connecting plate 202, thereby improving the working reliability of the automated tying tool of the present embodiment.

Please continue to refer to FIG. 17, in the present embodiment, the cylinder of riving knife 301 is arranged horizontally, and the toggle mechanism 303 is connected between the piston rod of the cylinder of riving knife 301 and the ejector pin of riving knife 302, wherein the piston rod extends out and retracts in the horizontal direction, and the ejector pin of riving knife 302 moves in the vertical direction. Such arrangement greatly reduces the longitudinal space occupation of the housing 10, so that the entire structure of the automated tying tool is more compact.

Figure 10:
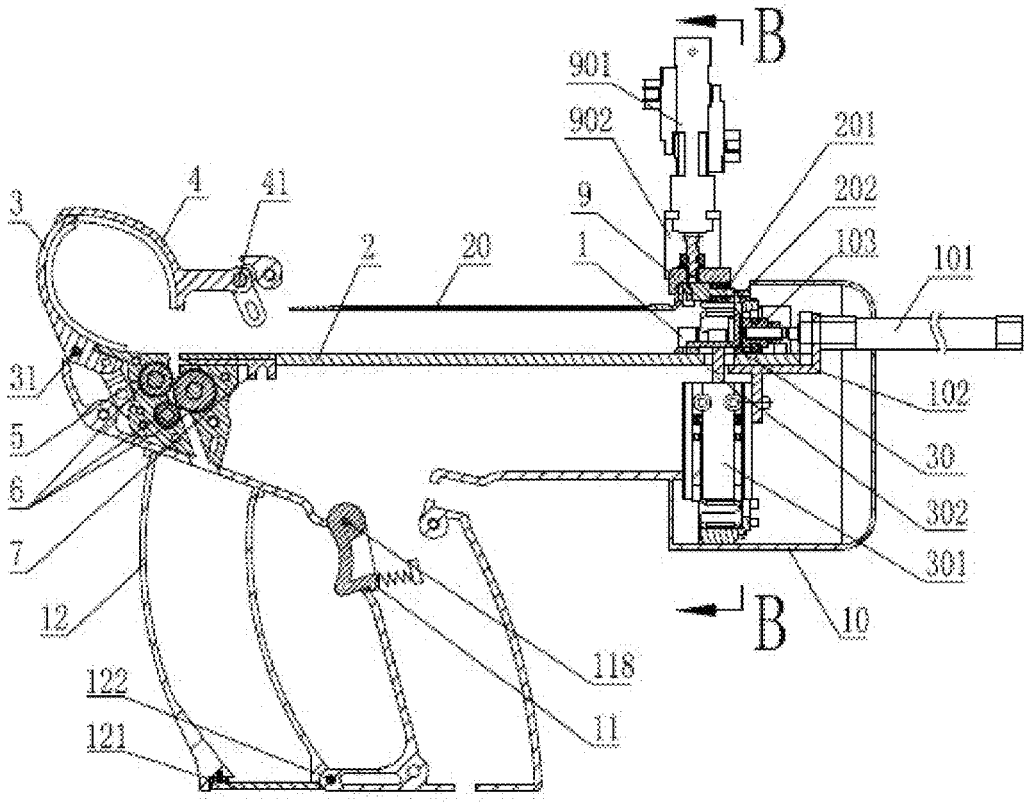
FIG. 10 is a sectional view taken along line A-A corresponding to FIG. 8.
Figure 11:
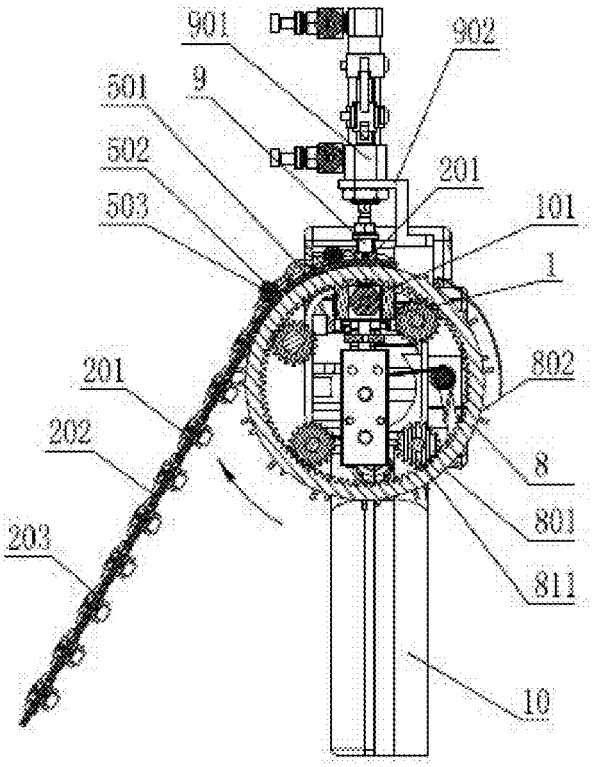
FIG. 11 is a sectional view taken along line B-B corresponding to FIG. 10, wherein a gear drives the wheel disc to perform an intermittent indexing motion.
Figure 12:
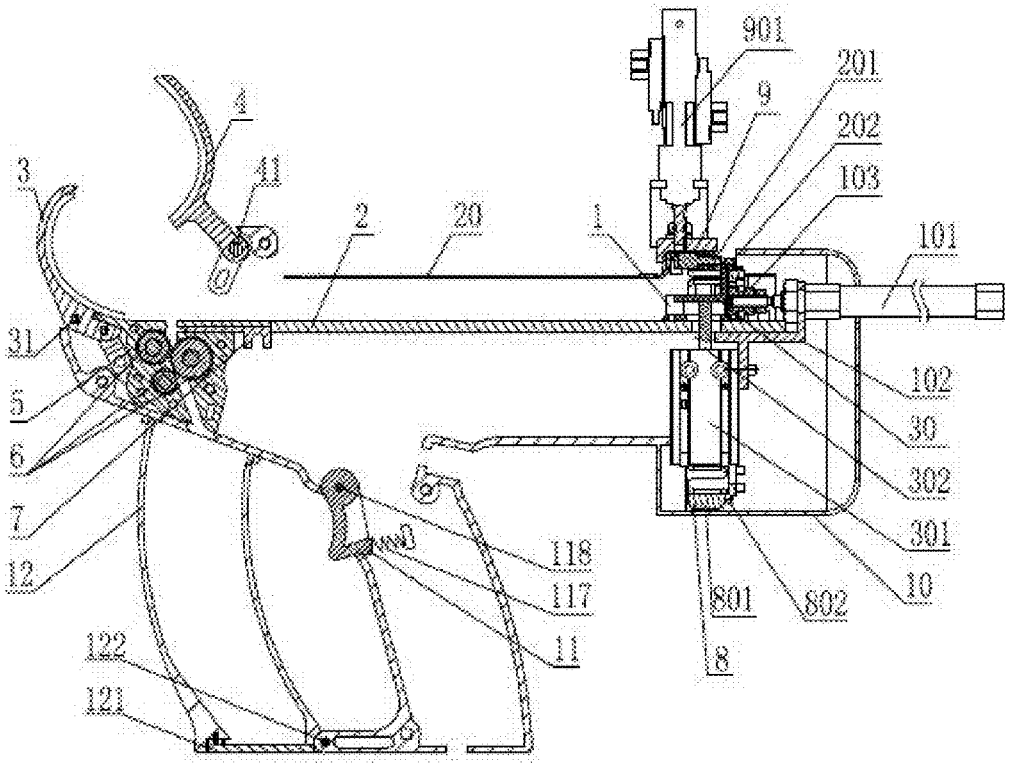
FIG. 12 is a sectional view taken along line A-A corresponding to FIG. 8, wherein a riving knife separates the tie from a connecting plate.
Figure 13:
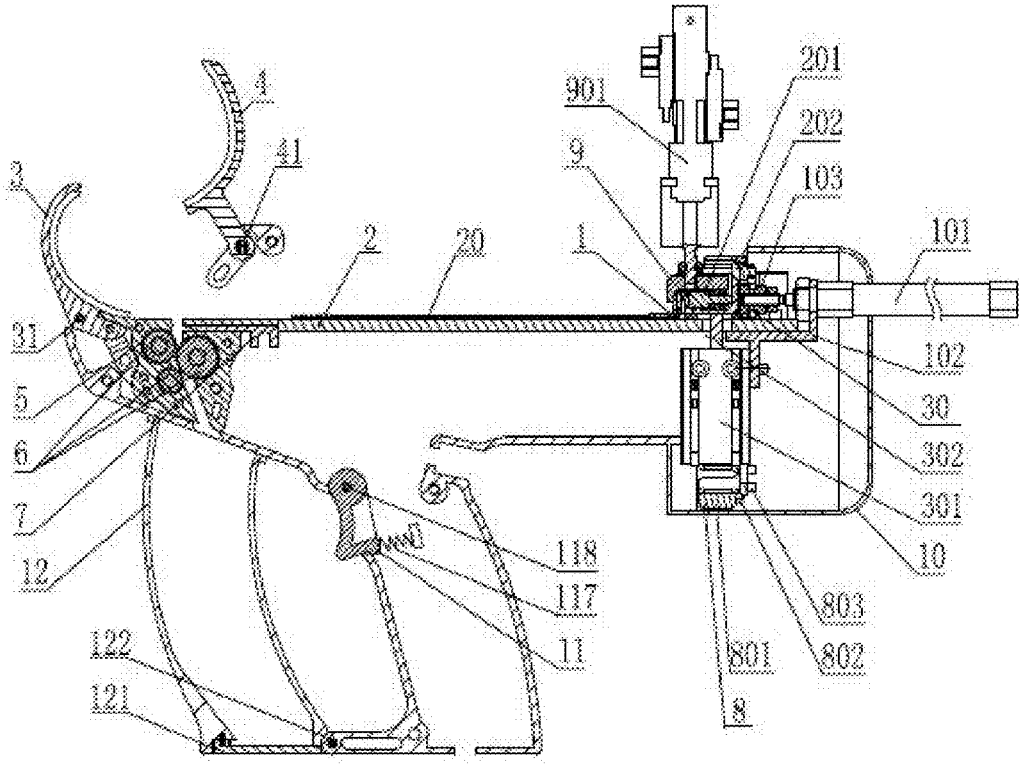
FIG. 13 is a sectional view taken along line A-A corresponding to FIG. 8, wherein the material pushing rod pushes the tie into the slider, and the riving knife retracts.
Figure 14:
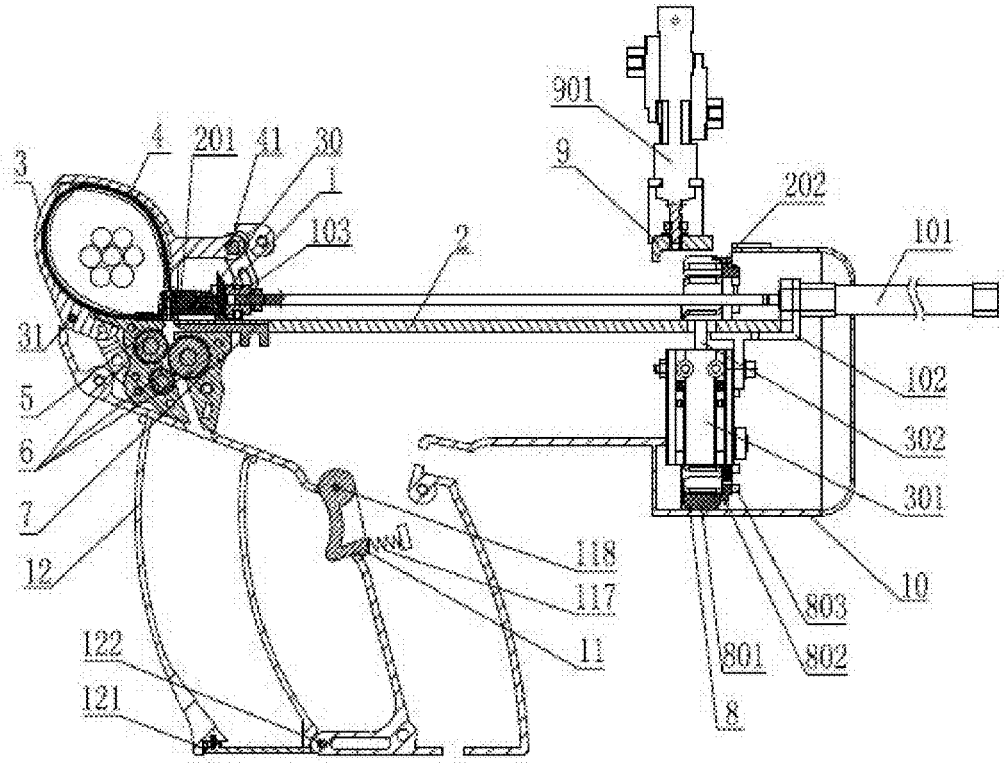
FIG. 14 is a sectional view taken along line A-A corresponding to FIG. 8, wherein the slider pushes the tie into guide slots in a first guide claw and a second guide claw.
Figure 15:
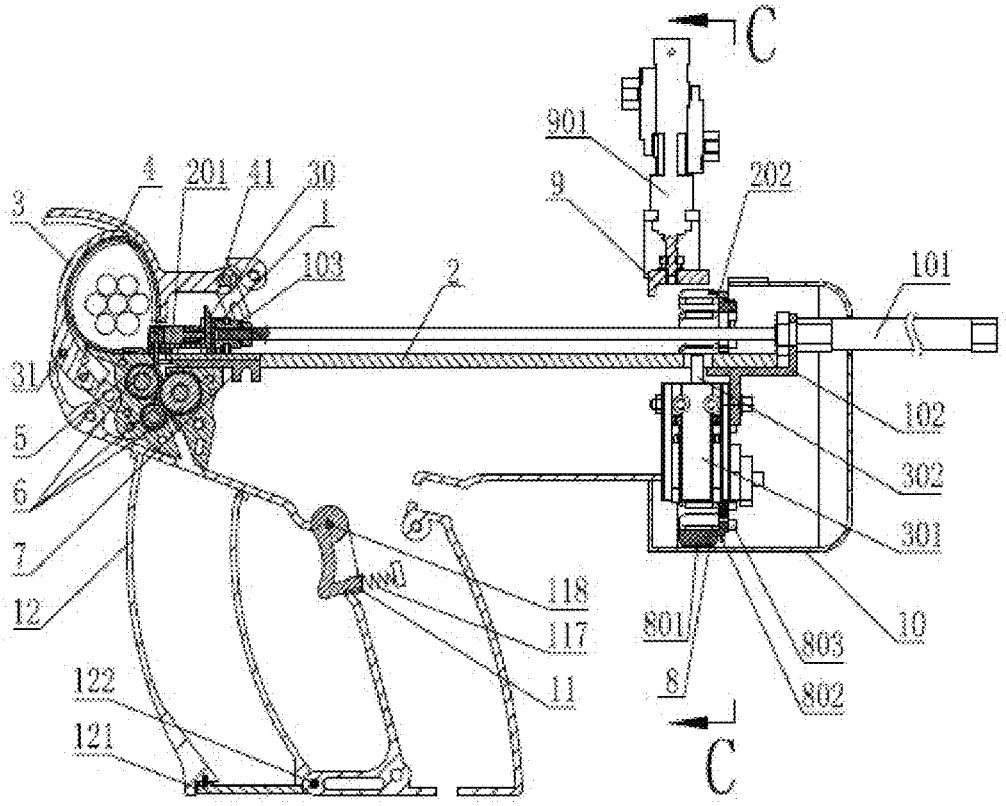
FIG. 15 is a sectional view taken along line A-A corresponding to FIG. 8, wherein the first guide claw hooks to insert a tail portion of the tie into a hole on a head portion of the tie.
Figure 16:
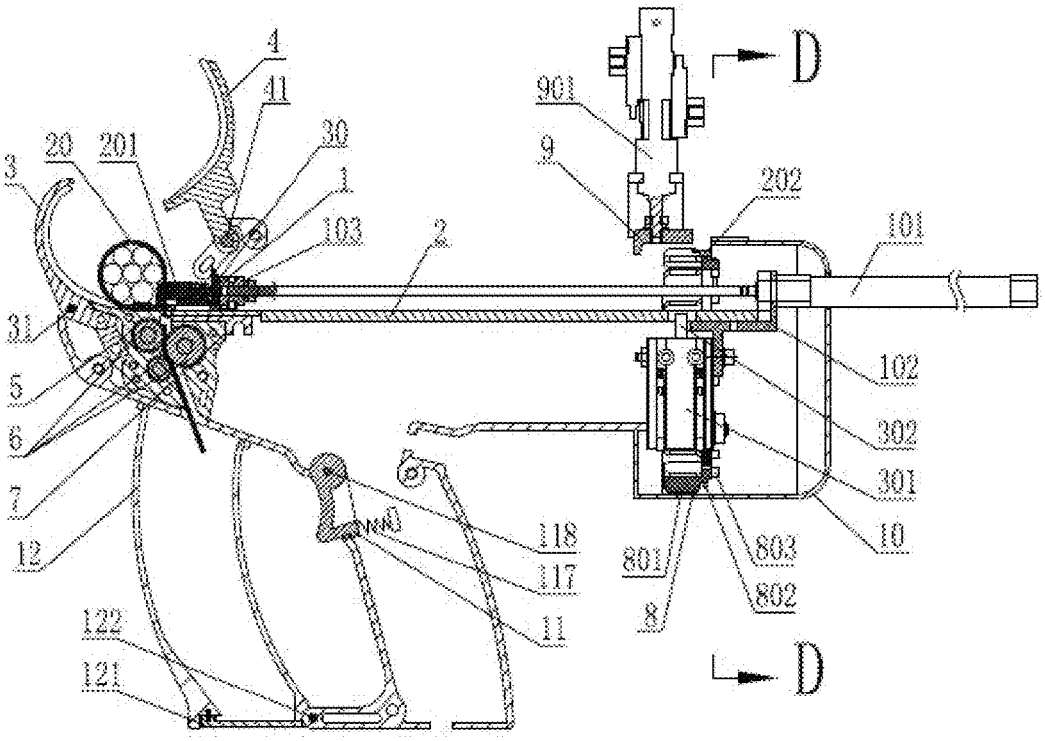
FIG. 16 is a sectional view taken along line A-A corresponding to FIG. 8, wherein a cutter cuts off the tensioned tie, the second guide claw is opened, and the tie is to exit from the slider.

Please continue to refer to FIG. 10 and FIG. 11, in the present embodiment, the wheel disc 801 is provided with internal teeth or external teeth, so that the wheel disc 801 can be driven by the gear 811 to perform the intermittent indexing motion.

It should be noted that in the present embodiment, the intermittent indexing motion of the wheel disc 801 can be driven by the above-mentioned gear mechanism, but it is not limited thereto, while other arrangement forms also can be adopted, specifically as shown in FIG. 15, FIG. 16, FIG. 18, FIG. 19 and FIG. 20. Specifically, the wheel disc 801 is driven by an indexing cam 804 so as to perform the intermittent indexing motion, in FIG. 18 and FIG. 20, the indexing cam 804 is sleeved on a cam shaft 805, the cam shaft 805 transmits power to the indexing cam 804, a rising edge of profile of the indexing cam 804 is in contact with one interval roller 803 fixed on the wheel disc 801, at this time, the indexing cam 804 rotates to drive the wheel disc 801 to rotate, and in FIG. 19, an equal-radius edge of the profile of the indexing cam 804 is in contact with two interval rollers 803 fixed on the wheel disc 801, at this time, the wheel disc 801 stops and is in a locked state. The direction of rotation of the wheel disc 801 and the indexing cam 804 is shown by arrows in FIG. 18, FIG. 19 and FIG. 20, and the indexing cam 804 is a double acting cam.

It further should be noted that in the present embodiment, it may be the structural form in which the above slider 1 and the guide rail 2 are located inside the circumference of the wheel disc 801 and the material pushing rod 9 is located outside the circumference of the wheel disc 801, but it is not limited thereto, while other forms also can be adopted, specifically as shown in FIG. 2, FIG. 5, FIG. 21, FIG. 22, and FIG. 23. Specifically, the slider 1 and the guide rail 2 are located outside the circumference of the wheel disc 801, and the material pushing rod 9 is located inside the circumference of the wheel disc 801. Moreover, a plurality of profiling recesses 807 matching with the shape of the head portion of tie 201 are uniformly distributed on an outer circumferential surface of the wheel disc 801, each profiling recess 807 is loaded with one tie 20, the wheel disc 801 rotates by one fixed interval each time, and the material pushing rod 9 pushes the head portion of tie 201 to the slider 1 to be pre-positioned.

In the present embodiment, when such structural form of the automated tying tool for realizing automatic binding of the tie 20, using the wheel disc 801 performing the intermittent indexing motion, is used for loose-packed ties, the wheel disc 801 is equivalent to a "cartridge holder", and an operator can manually load materials to assemble the loose-packed ties one by one onto the wheel disc 801, which is quite convenient.

It should be noted that in the present embodiment, the automated tying tool can realize a stepping feeding action of the tie 20 using the above wheel disc 801 performing the intermittent indexing motion, but it is not limited thereto, while other arrangement forms also can be adopted, specifically referring to FIG. 24-FIG. 29. Specifically, the stepping feeding mechanism 8 includes a material shifting pin 826 performing a translationally stepping motion, a material guiding plate 821, a feeding cylinder 823, a feeding cylinder bracket 822 and a cylinder of material shifting pin 825. In the above, the material guiding plate 821 is fixedly provided on the frame 5, for guiding the feeding of the interconnected ties, the feeding cylinder 823 is mounted on the frame 5, the cylinder of material shifting pin 825 is mounted at a power output end of the feeding cylinder 823, and the material shifting pin 826 is fixedly provided at a power output end of the cylinder of material shifting pin 825. Moreover, the feeding cylinder 823 is configured to linearly advance the cylinder of material shifting pin 825 by one fixed interval, and the cylinder of material shifting pin 825 is configured to insert the material shifting pin 826 into the positioning hole on the tie connecting plate 202 of the interconnected ties, so as to drive the interconnected ties to step translationally.

Such form of realizing the forward feeding of the interconnected ties in a translationally stepping manner is simple in structure and relatively low in configuration cost. Moreover, the pneumatic driving manner substantially will produce no environmental pollution.

Please continue to refer to FIG. 24-FIG. 29, in the present embodiment, the automated tying tool further may include a material pressing assembly for pressing the tie connecting plate 202 on the material guiding plate 821. In the above, the material pressing assembly is mounted on the frame 5. Specifically, the material pressing assembly includes a material pressing plate 501 and a material pressing wheel 502 pivoted to the material pressing plate 501, wherein a spring is connected between the material pressing plate 501 and the frame 5, and under the effect of the spring, the material pressing wheel 502 can press the tie connecting plate 202 on the material guiding plate 821.

An operating process of such automated tying tool adopting the translationally stepping manner is as follows: in an initial state, the material pressing plate 501 and the material pressing wheel 502 press, under the effect of the spring, the tie connecting plate 202 of the interconnected ties on the material guiding plate 821; then the cylinder of material shifting pin 825 is pushed out, to insert the material shifting pin 826 into the positioning hole on the interconnected tie connecting plate 202, moreover, the stroke of the feeding cylinder 823 is equal to the interval of the interconnected ties, and the feeding cylinder 823 is linearly pushed out to advance the interconnected ties by one interval; after one time of material feeding is completed, the cylinder of material shifting pin 825 drives the material shifting pin 826 to retract, and the feeding cylinder 823 drives the cylinder of material shifting pin 825 and the material shifting pin 826 to retract to prepare for feeding of next time.

Please continue to refer to FIG. 24-FIG. 29, in the present embodiment, the cylinder of material shifting pin 825 is fixedly provided on a piston rod of the feeding cylinder 823 through a material shifting cylinder bracket 824.

Figure 30:
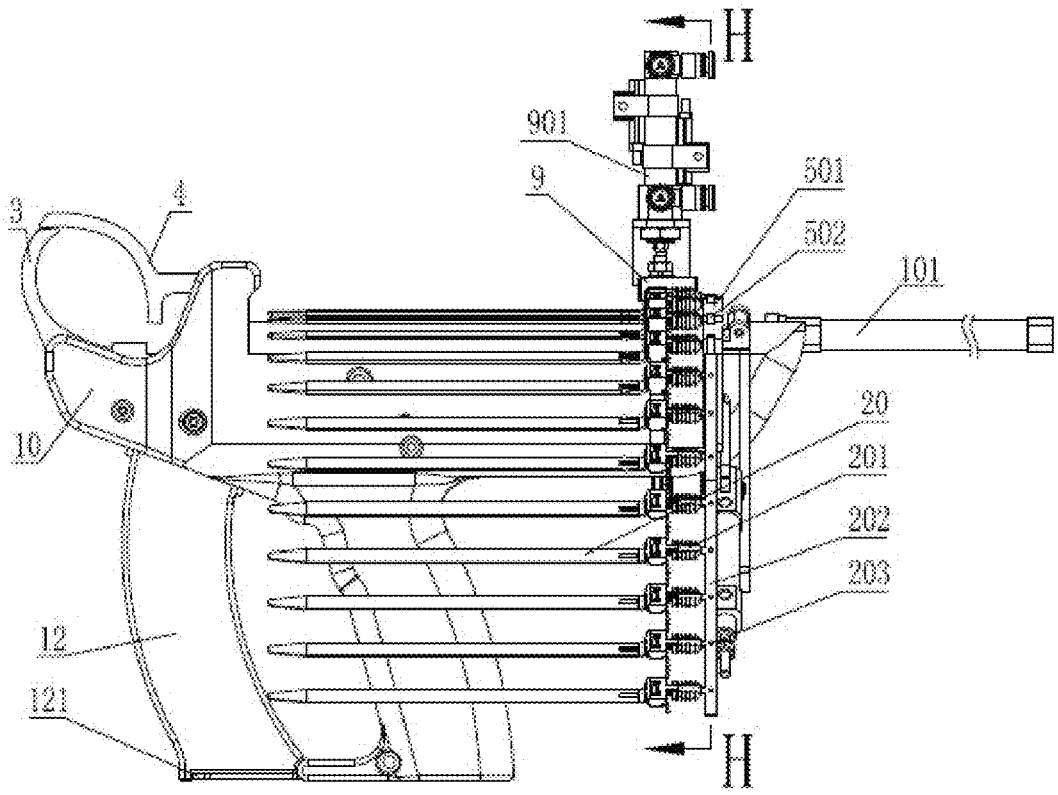
FIG. 30 is a front view of an automated tying tool provided in an embodiment of the present disclosure, wherein the material shifting pin swinging back and forth is adopted for feeding.
Figure 31:
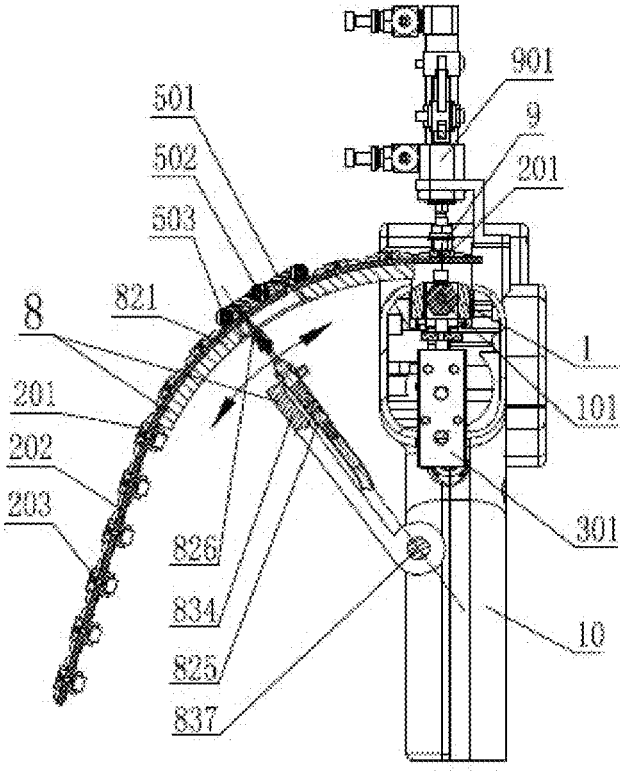
FIG. 31 is a sectional view taken along line H-H corresponding to FIG. 30, wherein the material shifting pin is to push the interconnected ties.
Figure 32:
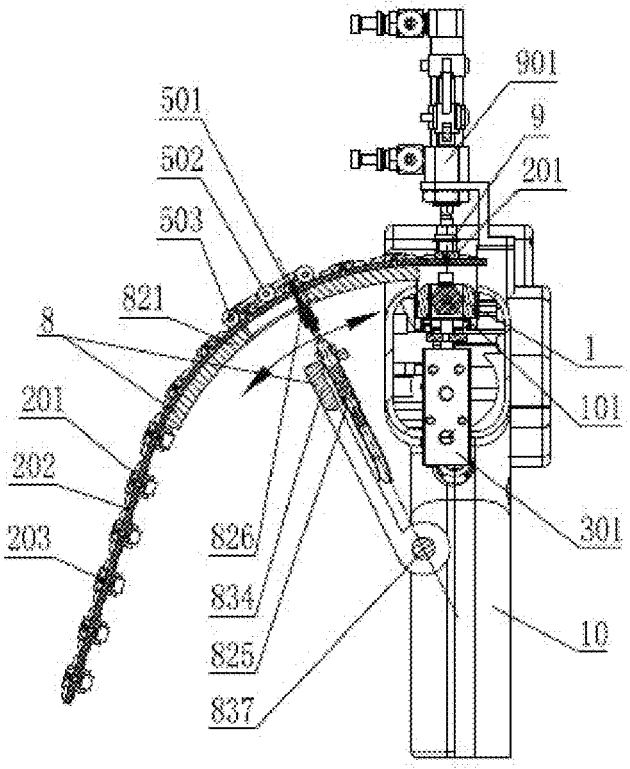
FIG. 32 is a sectional view taken along line H-H corresponding to FIG. 30, wherein the material shifting pin makes the interconnected ties move one interval.

Besides, in the present embodiment, apart from using the above wheel disc 801 performing the intermittent indexing motion and the material shifting pin 826 performing the translationally stepping motion, the automated tying tool also can adopt other forms to realize the stepping feeding action of the tie 20, specifically referring to FIG. 30, FIG. 31 and FIG. 32. Specifically, the stepping feeding mechanism 8 includes the material shifting pin 826 swinging back and forth, and the material guiding plate 821, a swinging bracket 834, a rotating shaft of swinging bracket 837 and the cylinder of material shifting pin 825, wherein the swinging bracket 834 is pivoted to the frame 5 through the rotating shaft of swinging bracket 837, and can swing back and forth along a material guiding direction, the cylinder of material shifting pin 825 is mounted on the swinging bracket 834, and the material shifting pin 826 is fixedly provided to the piston rod of the cylinder of material shifting pin 825.

Please continue to refer to FIG. 30-FIG. 32, such automated tying tool feeding in a swinging manner also includes the above-mentioned material pressing assembly, and the material pressing principle and the material pressing process are similar, and will not be described redundantly herein.

An operating process of such automated tying tool adopting the swinging stepping manner is as follows: in an initial state, the material pressing plate 501 and the material pressing wheel 502 press, under the action of the spring, the tie connecting plate 202 of the interconnected ties on the material guiding plate 821; then the piston rod of the cylinder of material shifting pin 825 extends out, to insert the material shifting pin 826 into the positioning hole on the tie connecting plate 202 of the interconnected ties; subsequently, the swinging bracket 834 swings, to advance the interconnected ties by one interval, so as to realize the feeding. After one time of feeding is completed, the cylinder of material shifting pin 825 drives the material shifting pin 826 to retract, and the swinging bracket 834 drives the cylinder of material shifting pin 825 and the material shifting pin 826 to retract to prepare for the feeding of next time.

In the present embodiment, the stepping feeding mechanism 8 not only can be driven by electric power, but also can be driven by pneumatic power, and also can be driven by a combined power of electric power and pneumatic power.

Besides, in the present embodiment, the first guide claw 3, the slider 1, the material pushing rod 9, the cutter 7 and the riving knife 30 not only can be driven by electric power, but also can be driven by pneumatic power, and also can be driven by a combined power of electric power and pneumatic power.

Figure 23:
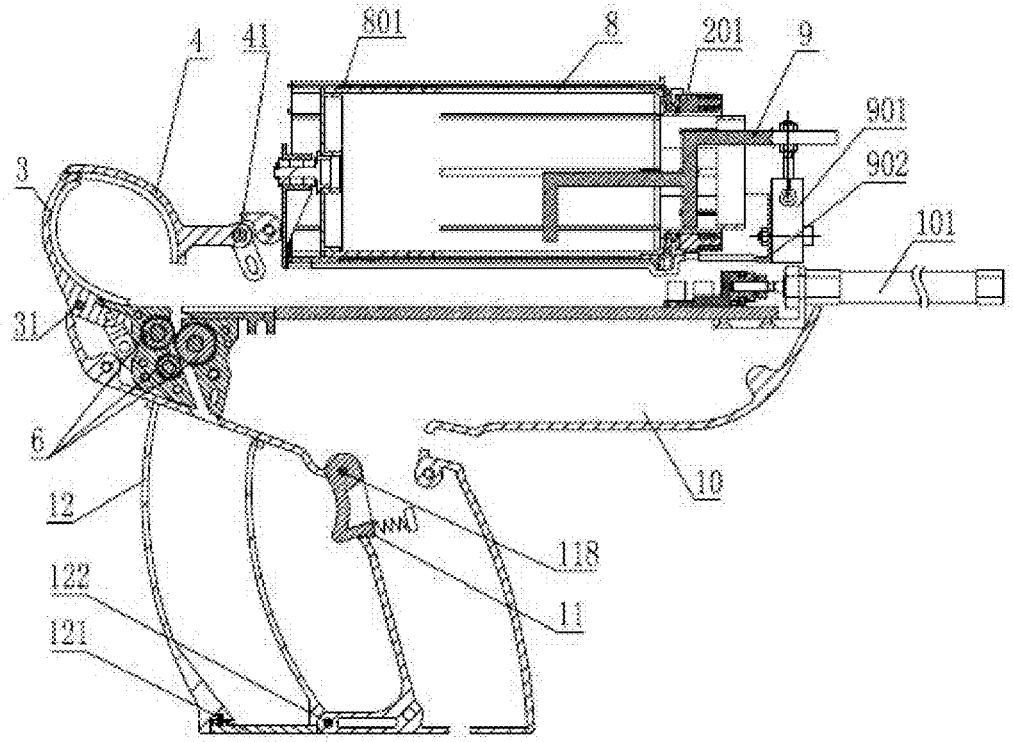
FIG. 23 is a sectional view taken along line E-E corresponding to FIG. 21, wherein the material pushing rod is located inside the circumference of the wheel disc.
Figure 24:
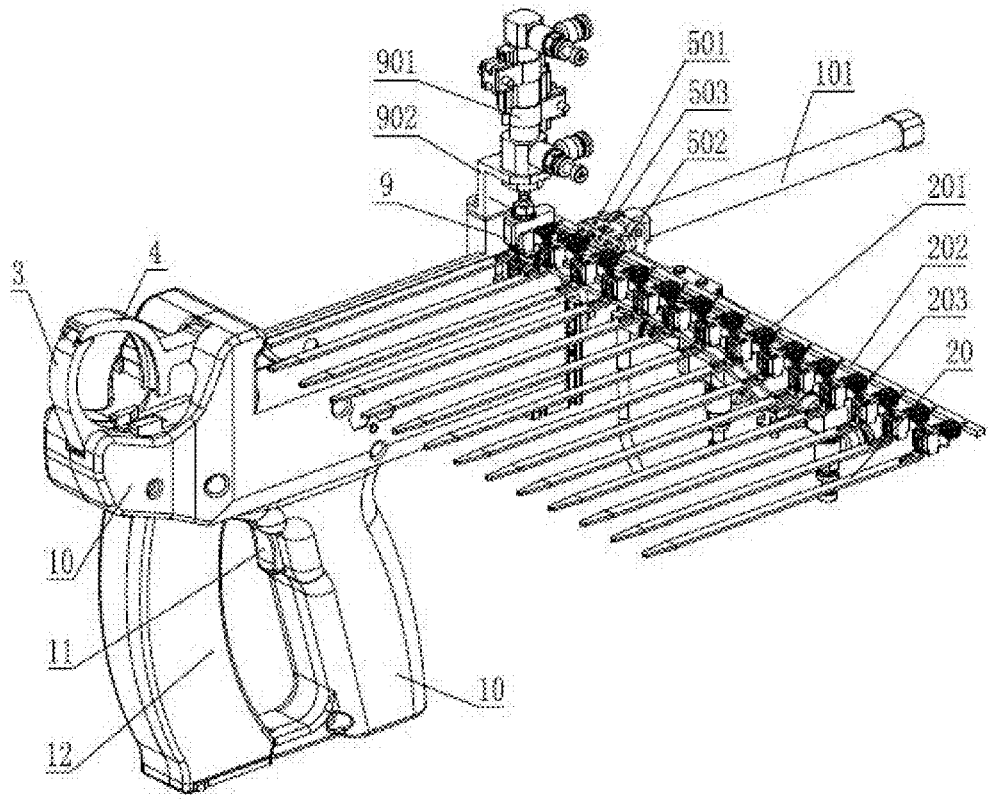
FIG. 24 is an isometric diagram of an automated tying tool provided in an embodiment of the present disclosure when being applied to interconnected ties, wherein a feeding mechanism stepping translationally is adopted.

Please continue to refer to FIG. 23, in the present embodiment, the second guide claw 4 can be driven by pneumatic power, and also can be driven by electric power, and further a connecting rod can be provided between the second guide claw 4 and the trigger 11, so as to drive the connecting rod by manually operating the trigger 11, to realize rotation of the second guide claw 4 around the rotation shaft of second guide claw 41. In the above, the trigger 11 rotates around a trigger center shaft 118.

Please continue to refer to FIG. 23, in the present embodiment, the automated tying tool further may include a waste box 12 mounted on the frame 5, wherein the waste box 12 is used to collect the cut waste. By means of such configuration, the cut waste is effectively collected, thus the environmental pollution caused by the waste is reduced, and meanwhile, personal damage risk caused by sputtering of the waste is also reduced, then the safety is greatly improved.

Specifically, the waste box 12 is arranged below the tensioning wheel 6, and is communicated with a channel on the frame 5 for extending out the tail portion of the tie 20. Moreover, a discharging port is provided at a bottom portion of the waste box 12, a door panel of waste box 121 is arranged at the discharging port, and the door panel of waste box 121 is pivoted to a box body of the waste box 12 through a rotating shaft of door panel 122.

After the automated tying tool works for a period of time, the door panel of waste box 121 can be rotated to open, so that centralized treatment on the waste material in the waste box 12 is realized.

The automated tying tool realizes automatic binding of one-piece fixing ties with irregular head shapes. Moreover, as shown in FIG. 1, when a common tie needs to be used to realize automatic binding operation, the protruding rib 104 or the profiling recess 807 of the slider 1 and the profiling recess 807 on the wheel disc 801 can be made into shapes matching with the head portion of the common tie, at this time, the automated tying tool can be suitable for automatic binding of the common tie with a regular head shape.

In the present embodiment, the tie 20 may be a nylon tie.

In addition, the present embodiment further provides an automatic tying method, and when binding loose-packed ties, this automatic tying method includes following steps:

S1: placing a tie 20 on a stepping feeding mechanism 8, which performs an intermittent indexing motion and rotates by one interval, to convey the tie 20 to a position where a symmetrical center plane of the tie 20 is coincident with a center plane of the automated tying tool;

S2: enabling a material pushing rod 9 to act to push the tie 20 onto the slider 1 to be pre-positioned;

S3: enabling the slider 1 to move to drive the tie 20 to slide from the pre-positioning position in the step S2 to a binding operation position, wherein in a sliding process of the slider 1, a tie body of the tie 20 is curled in the guide slots in a first guide claw 3 and a second guide claw 4, and enabling the first guide claw 3 to rotate to make a tail portion of the tie pass through a hole on a head portion of tie 201;

S4: enabling a tensioning wheel 6 to rotate to tighten the tie 20, and cutting off the tensioned tie 20 with a cutter 7; and S5: allowing the bound tie head to exit from the slider 1, wherein the slider 1 returns from the binding operation position of the tie to the pre-positioning position of the tie.

When the interconnected ties are bound by the automated tying tool, the tie 20 moving to the pre-positioning position first needs to be separated from the tie connecting plate 202 using a riving knife 30, then with the sliding effect of slider 1, the tie body of the tie separated above is conveyed into the guide slots of the first guide claw 3 and the second guide claw 4.

Figure 33:
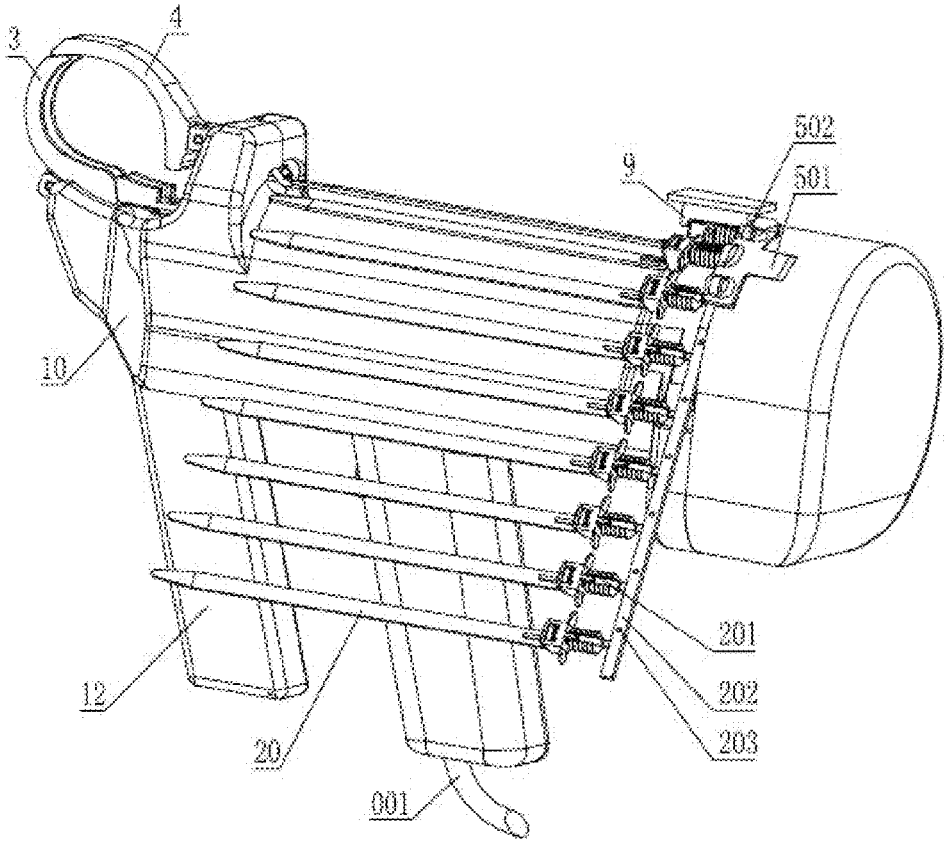
FIG. 33 is an isometric diagram of an all-electric automated tying tool provided in an embodiment of the present disclosure, which is applied to interconnected ties.
Figure 34:
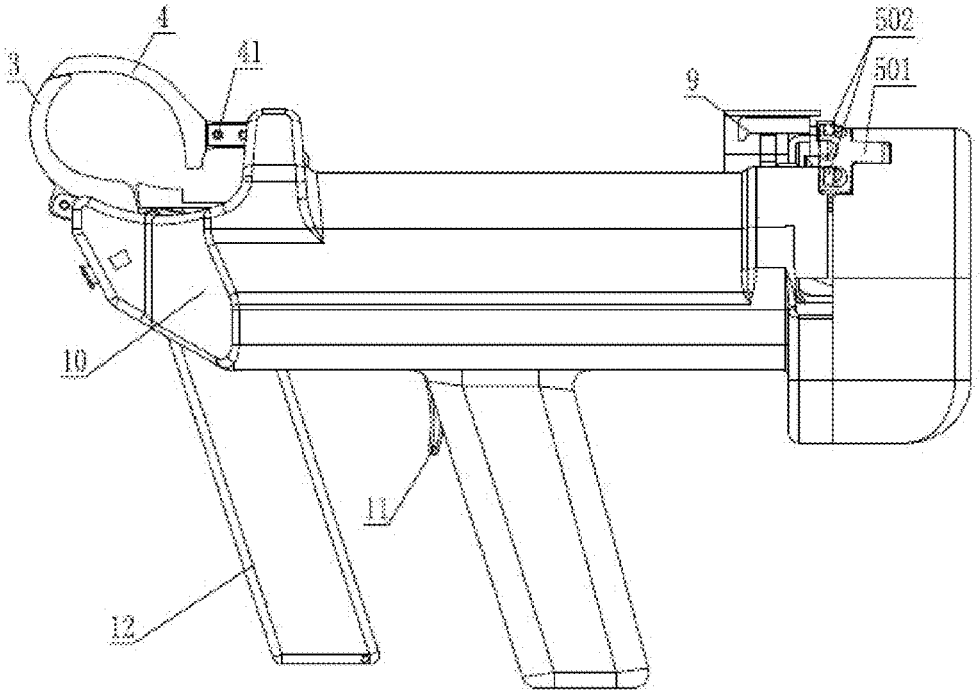
FIG. 34 is a front view of an all-electric automated tying tool provided in an embodiment of the present disclosure.
Figure 35:
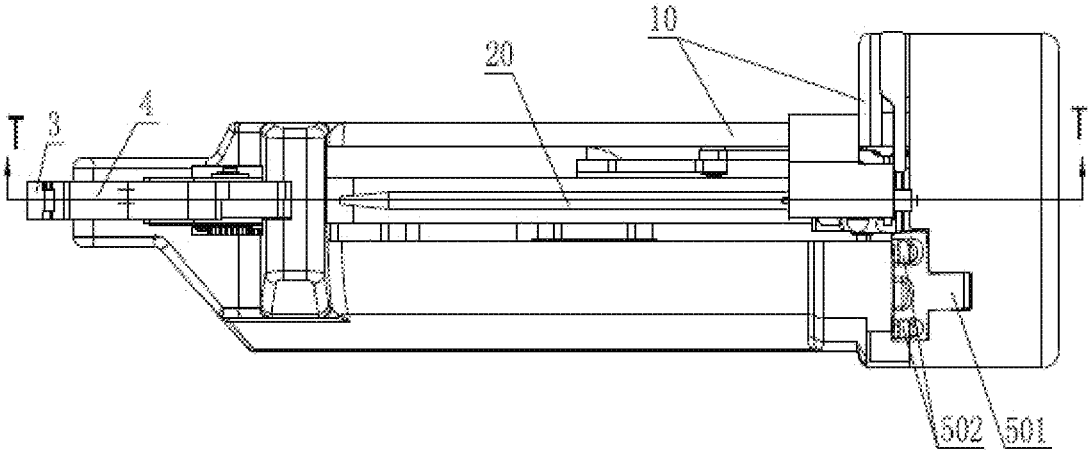
FIG. 35 is a top view corresponding to FIG. 34.
Figure 36:
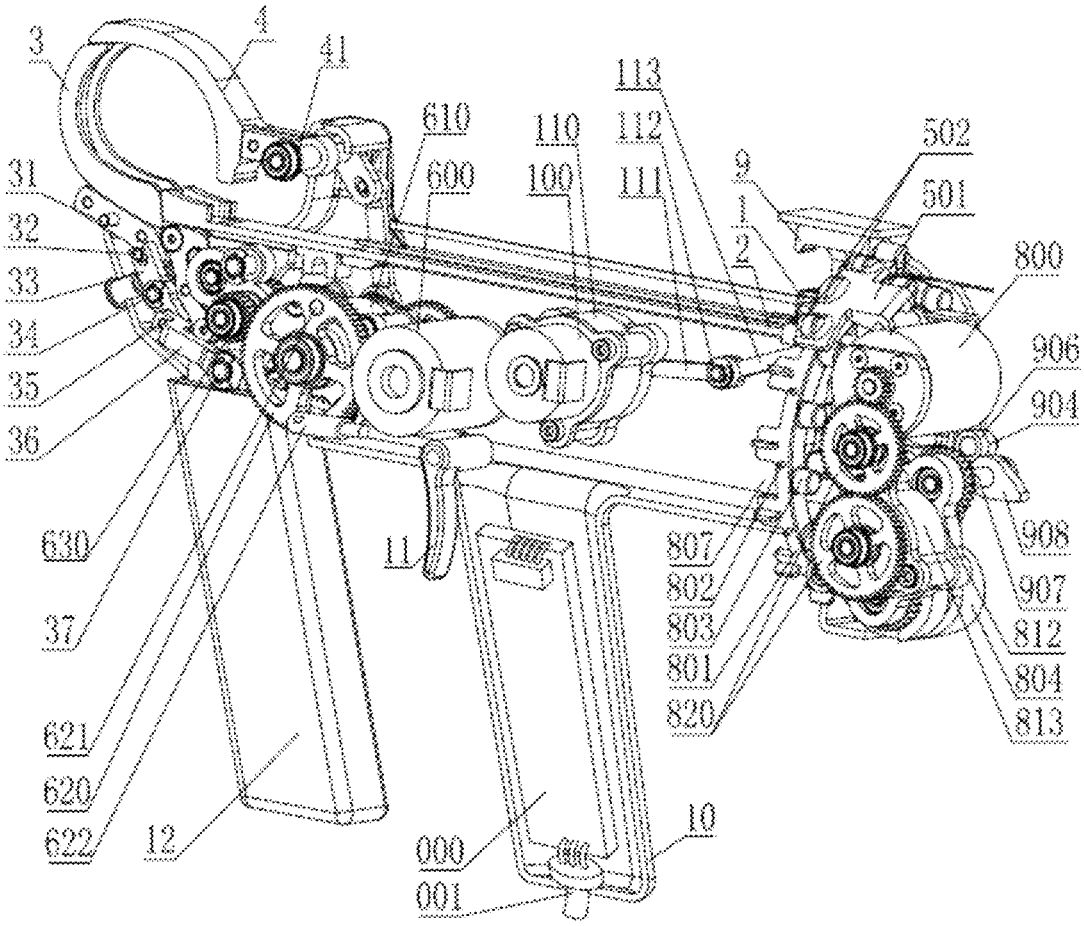
FIG. 36 is an isometric diagram of an all-electric automated tying tool provided in an embodiment of the present disclosure, with a shell being removed.

Please continue to refer to FIG. 33-FIG. 36, in the present embodiment, first guide claw 3, the slider 1, the material pushing rod 9, the cutter 7 and the riving knife 30 are all driven by a motor. FIG. 33 is an isometric diagram of an embodiment of the present disclosure, FIG. 34 is a front view, FIG. 35 is a top view thereof, FIG. 36 is an isometric diagram with the shell being removed, showing layout of major parts inside, and FIG. 36 also displays a linkage mechanism in which the wheel disc 801, the material pushing rod 9 and the riving knife 30 are driven by a motor 800. A motor 100, a reduction gearbox 110, a motor 600, a reduction gearbox 610, a motor 800 and a gear box 813 are all mounted on the frame 5.

Please continue to refer to FIG. 37-FIG. 41, in the present embodiment, the movement relationship between the linkage mechanism, in which the wheel disc 801, the material pushing rod 9 and the riving knife 30 are driven by the motor 800 (see FIG. 36), and the slider 1 is mainly shown, and other parts are omitted.

Figure 37:
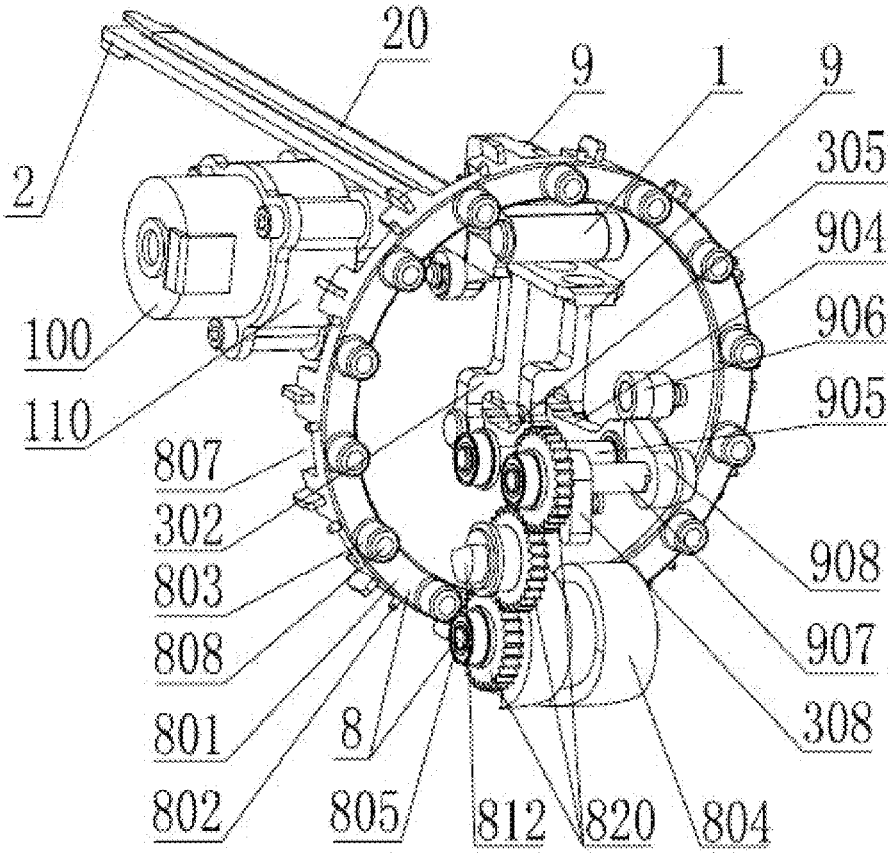
FIG. 37 is an isometric diagram of an all-electric automated tying tool provided in an embodiment of the present disclosure, with a shell, a guide claw, and a tensioning wheel mechanism being removed, and mainly showing the linkage action of the indexing of the wheel disc, the riving knife, and the material pushing rod.

FIG. 37 is an isometric diagram of assembling of wheel disc 801, material pushing rod 9, riving knife 30 and the slider 1, and other parts such as the motor 800, the gear box 813 and the housing are omitted. As shown in FIG. 36 and FIG. 37, the power of the motor 800 is transmitted to a gear shaft 812 through the gear box 813 (the gear shaft 812 is an output shaft of the reduction gearbox), a gear 820 is sleeved on the gear shaft 812, the gear 820 transmits the power to an indexing cam 804 and a cam shaft 907, specifically, a cam of riving knife 308 and a cam of material pushing rod 908 are arranged on the cam shaft 907 at an interval along an axial direction of the cam shaft, the cam of riving knife 308 and the cam of material pushing rod 908 are both fixedly sleeved on the cam shaft 907, and a connecting rod of ejector pin of riving knife 305 and a connecting rod of material pushing rod 904 both can rotate around an axis of a center shaft of connecting rod 905. Axes of the indexing cam 804 and the wheel disc 801 are arranged in a manner of being spatially perpendicular but not intersecting to each other, the wheel disc 801 rotates by one interval every time the indexing cam 804 rotates by one circle, so that the wheel disc 801 performs the intermittent indexing motion, and the indexing cam 804 is also a double acting cam with a self-locking function.

Figure 38:
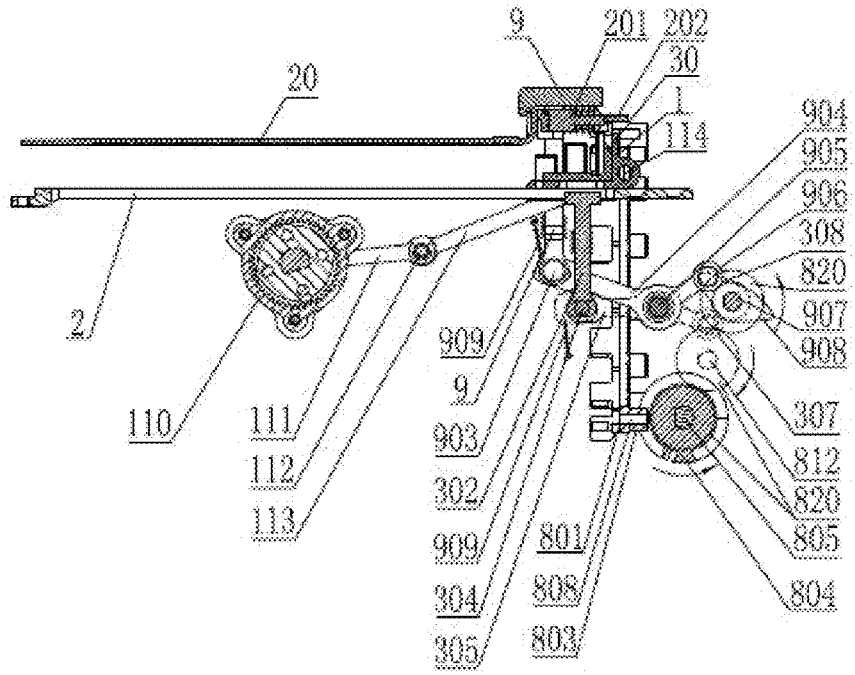
FIG. 38 is a sectional view taken along line T-T corresponding to FIG. 35, wherein the wheel disc has just finished an indexing action, and a cam of riving knife is to act on a connecting rod of an ejector pin of the riving knife.

In FIG. 38, the indexing cam 804 has just completed the indexing action on the wheel disc 801, at this time the gear 820 drives the indexing cam 804 to continue to rotate, while the wheel disc 801 is locked by the indexing cam 804; the cam shaft 907 driven by the gear 820 drives a rising edge of the cam of riving knife 308 to act on the cam roller 307, so that the connecting rod of ejector pin of riving knife 305 rotates clockwise around the center shaft of connecting rod 905, the connecting rod of ejector pin of riving knife 305 drives the ejector pin of riving knife 302 to move upwards through a pin shaft 304, and the ejector pin of riving knife 302 drives the riving knife 30 upwards, to slide upwards inside the slider 1 to separate the tie 20 from the tie connecting plate 202.

Figure 39:
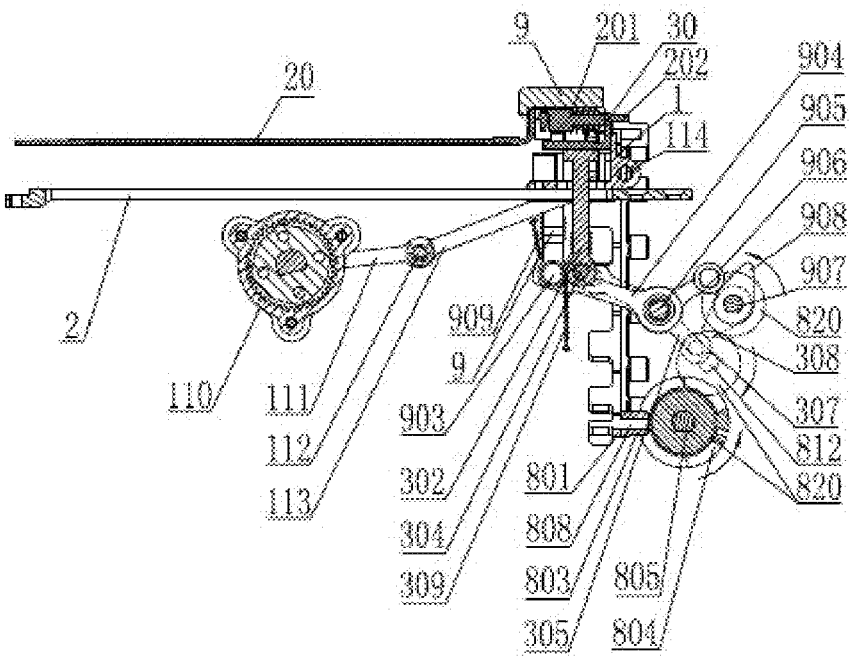
FIG. 39 is a sectional view taken along line T-T corresponding to FIG. 35, wherein the cam of riving knife is to act on a connecting rod of an ejector pin of the riving knife, an ejector pin of the riving knife pushes the riving knife upwards, and the riving knife separates the tie from a tie connecting plate.

In FIG. 39, the riving knife 30 has cut and separated the tie 20 from the tie connecting plate 202, at this time the gear 820 drives the indexing cam 804 to continue to rotate, while the wheel disc 801 is locked by the indexing cam 804; the cam shaft 907 driven by the gear 820 drives a rising edge of the cam of material pushing rod 908 to act on the cam roller 906, so that the connecting rod of material pushing rod 904 rotates anticlockwise around the center shaft of connecting rod 905, the connecting rod of material pushing rod 904 drives the material pushing rod 9 to move downwards through the pin shaft 903, and the material pushing rod 9 presses the tie 20 that has been cut off onto a bottom plate of the riving knife 30, at which time, a falling edge of the cam of riving knife 308 contacts the cam roller 307, and a reset spring of ejector pin of riving knife 309 pulls the ejector pin of riving knife 302 downwards to reset.

Figure 40:
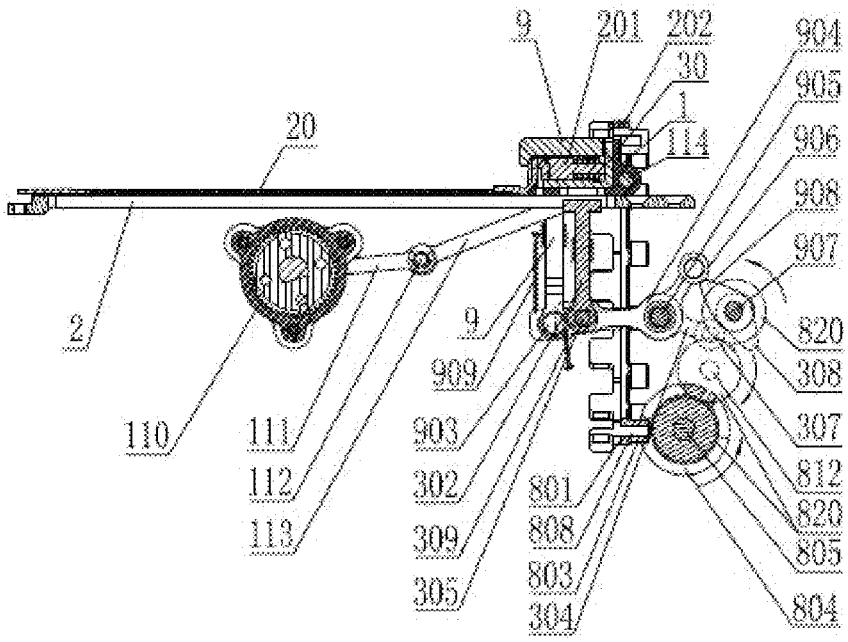
FIG. 40 is a sectional view taken along line T-T corresponding to FIG. 35, wherein a cam of material pushing rod is to act on a connecting rod of the material pushing rod, the material pushing rod pushes the tie and the riving knife downwards, and the tie is positioned inside the slider.

In FIG. 40, the material pushing rod 9 pushes the tie 20 that has been cut off together with the riving knife 30 downwards to the inside of the slider 1 to be positioned, at this time, the gear 820 drives the indexing cam 804 to rotate continuously while the wheel disc 801 is locked by the cam 804, the cam shaft 907 driven by the gear 820 drives the falling edge of the cam of material pushing rod 908 to contact the cam roller 906, and the reset spring of material pushing rod 909 pulls the material pushing rod 9 upwards to reset.

In the operation process, the motor 800 outputs power to a middle gear 820 through the gear box 810, so that an upper gear 820 and a lower gear 820 which are in meshing transmission with the middle gear 820 rotate, wherein the lower gear 820 will drive the indexing cam 804 to rotate, and the indexing feeding of the wheel disc 801 is realized by the indexing cam 804; meanwhile, the upper gear 820 drives the cam shaft 907 to rotate, and in the rotating process of the cam shaft 907, the cam of riving knife 308 rotates to finally realize rising of the riving knife 30 and thus complete the material cutting action; and when the cam shaft 907 rotates, the cam of material pushing rod 908 rotates, such that a pressing action of the material pushing rod 9 is realized. In the above, the wheel disc 801 rotates for material feeding; then, the riving knife 30 is risen to cut the material; thereafter, the material pushing rod 9 presses down the riving knife 30; finally, the material pushing rod 9 returns to an uppermost position (FIG. 38), which is one operation cycle to realize material feeding, material cutting and reset of the riving knife 30. A plurality of operation cycles are performed continuously, which can realize the automatic cutting action of the interconnected ties.

Such arrangement form driven in an all-electric manner enables the material feeding of the wheel disc 801, the rising and material cutting of the riving knife 30 and the material pressing action of the material pushing rod 9 to be all driven by one motor 800, moreover, various steps are carried out in sequence without mutual interference, thereby not only reducing the arrangement cost of the power device and enabling the space arrangement to be more compact, but also having higher automation degree, and being capable of completing the above actions in the continuous rotation process of the gear 820, and thereby simplifying the control logic.

Figure 41:
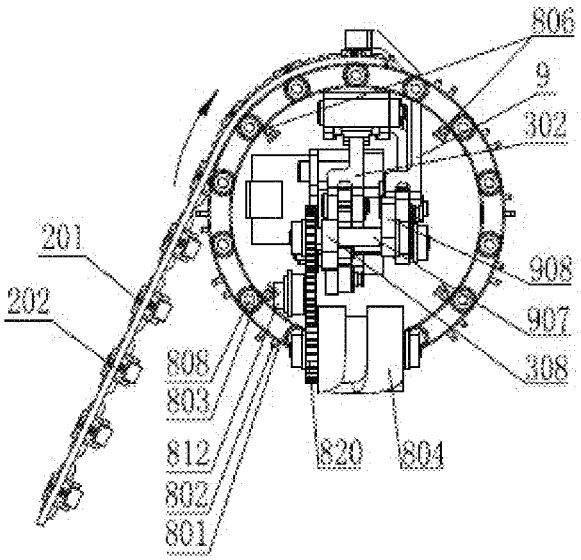
FIG. 41 is a right view corresponding to FIG. 38, FIG. 39, and FIG. 40.

FIG. 41 is a right view corresponding to FIG. 38, FIG. 39 and FIG. 40, wherein a direction of arrow represents a feeding direction of the tie 20.

Figure 42:
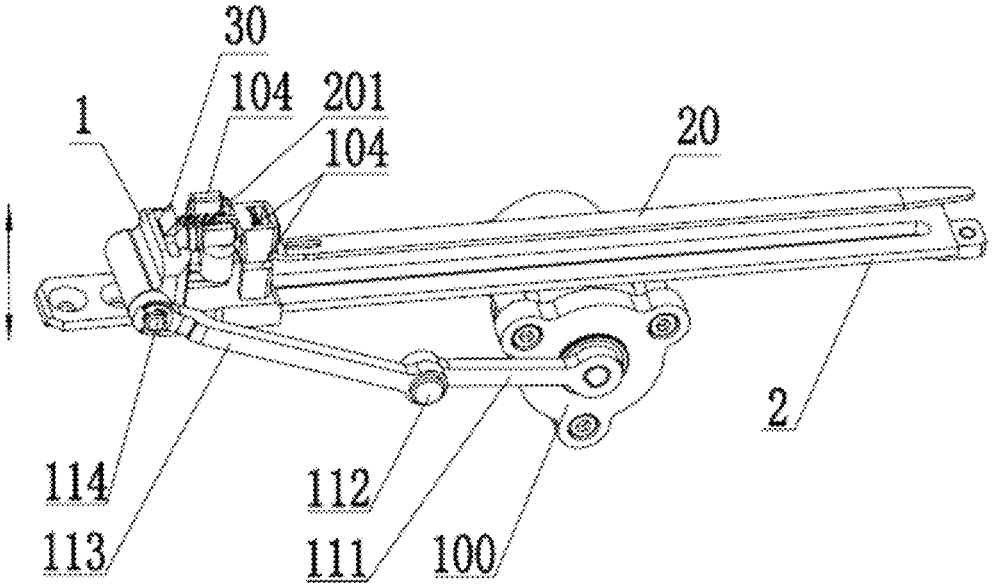
FIG. 42 is an isometric diagram of assembling of guide rail, the slider and riving knife provided in an embodiment of the present disclosure, a part of protruding ribs on the slider are formed integratedly with the riving knife, and the riving knife can slide up and down in the guide rail according to a direction of arrow in the figure.
Figure 43:
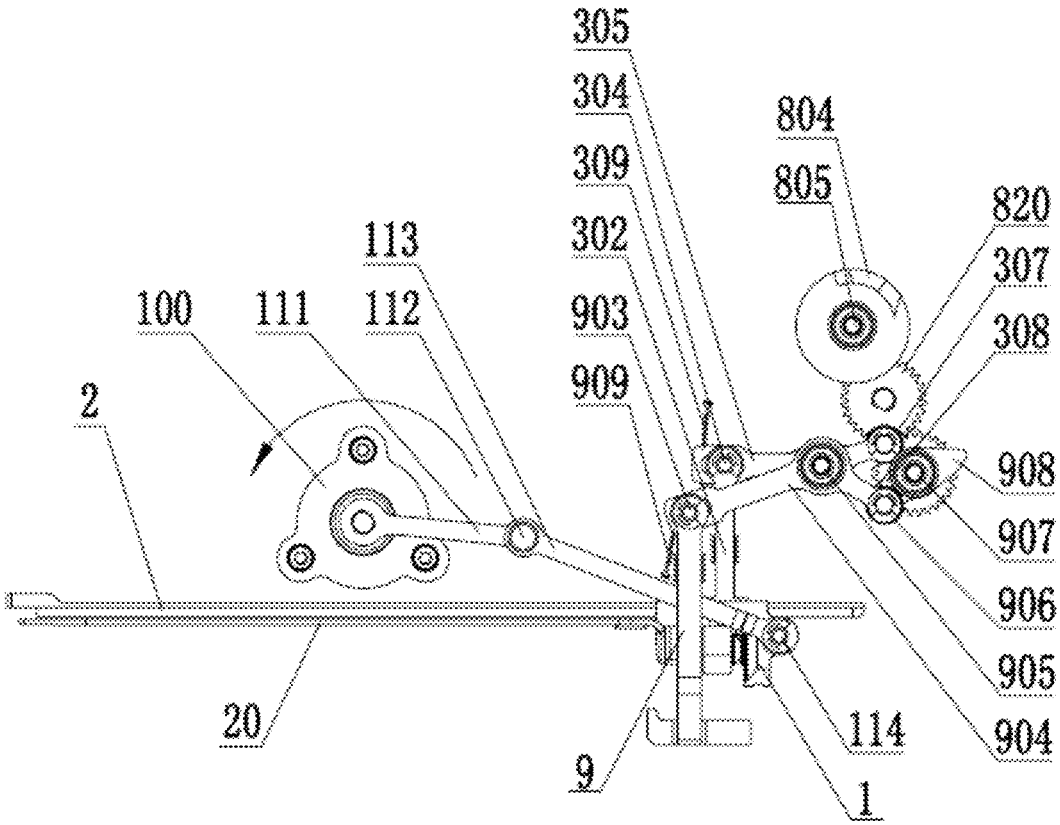
FIG. 43 is a rear view with reference to FIG. 34, with a shell, a guide claw, and a tensioning wheel mechanism being removed, and mainly showing the linkage action mechanism of the indexing of the wheel disc, the riving knife, and the material pushing rod, wherein the slider is located in a pre-positioning position of the tie.
Figure 44:
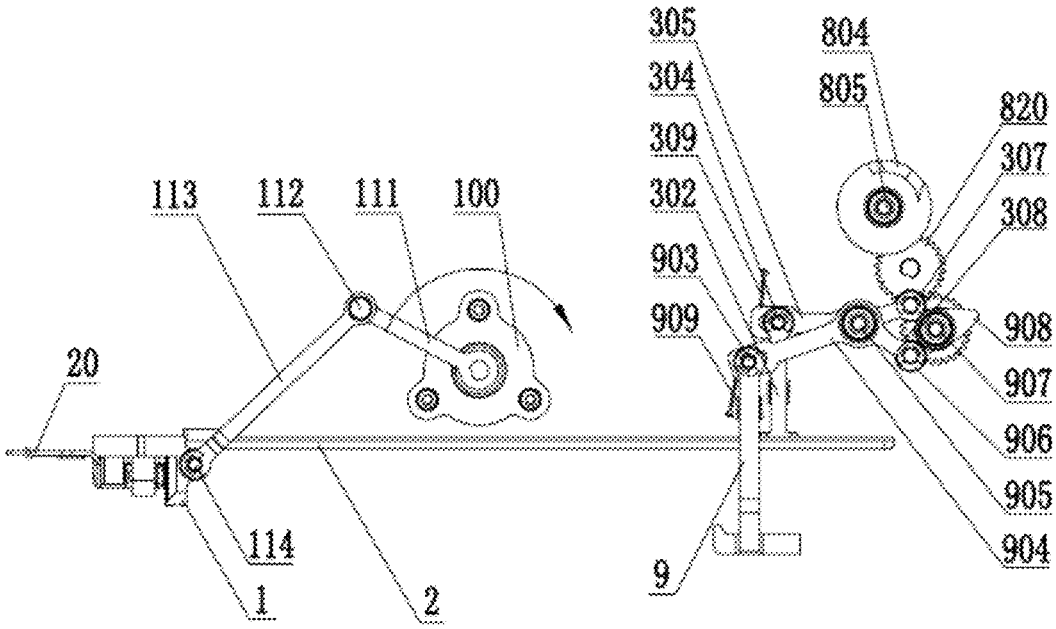
FIG. 44 is a rear view with reference to FIG. 34, with a shell, a guide claw, and a tensioning wheel mechanism being removed, and mainly showing the linkage action mechanism of the indexing of the wheel disc, the riving knife, and the material pushing rod, wherein the slider together with the tie is sent to a binding position.
Figure 45:
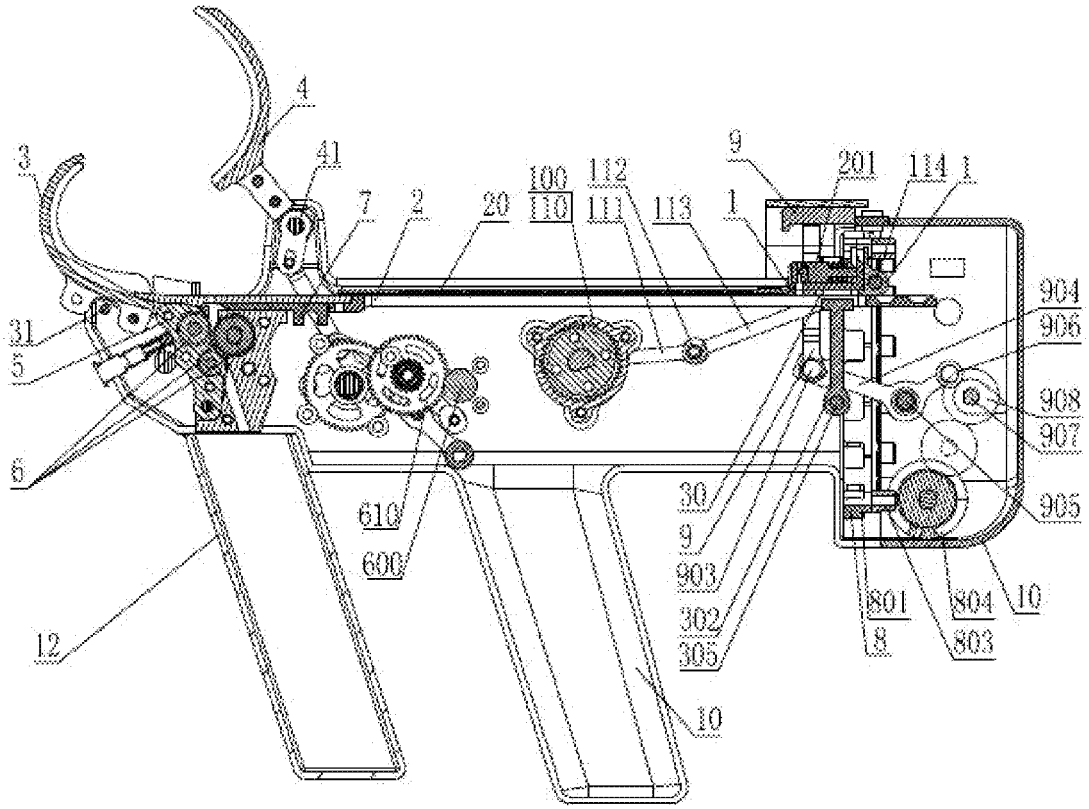
FIG. 45 is a sectional view taken along line T-T corresponding to FIG. 35, wherein the material pushing rod retracts to an upper end, and the tie is positioned inside the slider.
Figure 46:
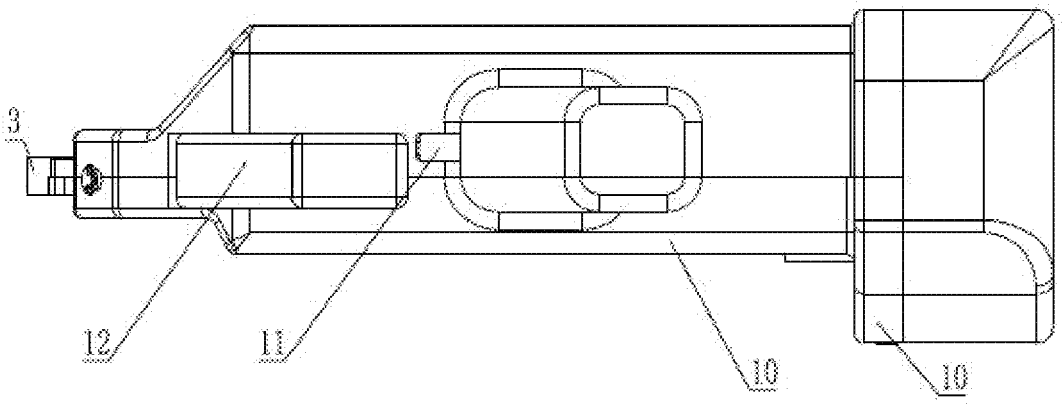
FIG. 46 is a bottom view corresponding to FIG. 45.

Please continue to refer to FIG. 42-FIG. 44, in the present embodiment, FIG. 42 is an isometric diagram showing an assembling relationship among the slider 1, the guide rail 2, the riving knife 30, the tie 20, and a swinging arm 111, a pin shaft 112 and a connecting rod 113 for driving the slider 1; and FIG. 43 and FIG. 44 are partial structural schematic views of the automated tying tool.

As shown in FIG. 42, the riving knife 30, provided in an L shape, includes a vertical section and a horizontal section, wherein the vertical section acts as a cutting portion for achieving material separating, and the horizontal section acts as a sliding portion for sliding on the guide rail 2. Among the four protruding ribs 104, two protruding ribs 104 are formed integratedly with the slider 1; and the other two protruding ribs 104 are formed integratedly with the riving knife 30 and can slide up and down along with the riving knife 30 relative to the slider 1 in a direction of arrow shown in FIG. 42.

Alternatively, all of the four protruding ribs 104 are formed integratedly with the riving knife 30, and can slide up and down along with the riving knife 30 relative to the slider 1 in a direction of arrow shown in FIG. 42.

Alternatively, the four protruding ribs 104 are all formed integratedly with slider 1.

As shown in FIG. 43, after the ejector pin of riving knife 302 and the material pushing rod 9 are reset, the motor 100 drives the swinging arm 111 through the reduction gearbox 110 to rotate in an anticlockwise direction (a direction of arrow in FIG. 43), the swinging arm 111 drives the connecting rod 113 through the pin shaft 112, and the connecting rod 113 drives, through the pin shaft 114, slider 1 together with the tie 20 to slide along the guide rail 2 from the pre-positioning position to the binding position, that is, to move from the right side to the left side in FIG. 43, to the position shown in FIG. 44.

Please continue to refer to FIG. 44, after the binding is completed, the head portion of tie 201 exits from the slider 1, the motor 100 drives the swinging arm 111 to rotate in a clockwise direction (a direction of arrow in FIG. 44), the swinging arm 111 drives the connecting rod 113 through the pin shaft 112, and the connecting rod 113 drives, through the pin shaft 114, the slider 1 together with the tie 20 to slide along the guide rail 2 from the binding position to the pre-positioning position.

Figure 50:
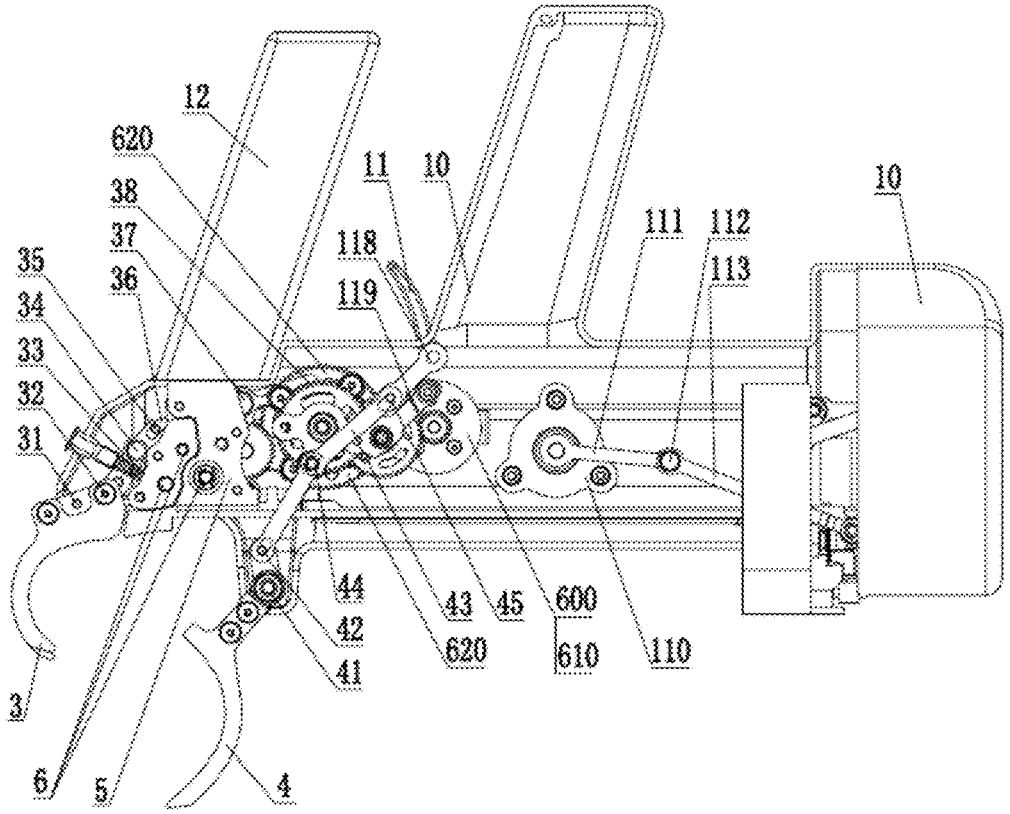
FIG. 50 is a rear view with reference to FIG. 34, with the shell being removed, showing that the second guide claw is connected by a trigger through a connecting rod mechanism, the second guide claw is in an open state, and the slider is located in the pre-positioning position of the tie, and also showing that the tensioning wheel performs the transmission by the motor.
Figure 51:
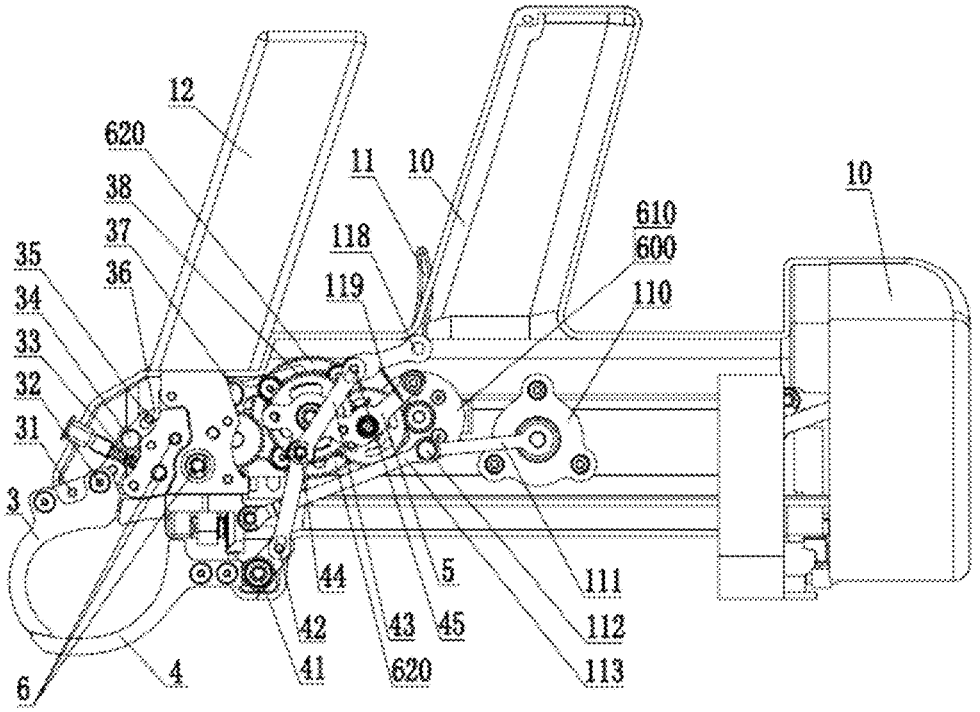
FIG. 51 is a rear view with reference to FIG. 34, with the shell being removed, and showing that the second guide claw is driven to close by a trigger through a connecting rod, the slider sends the tie to a binding position, and the tensioning wheel is driven by the motor.
Figure 52:
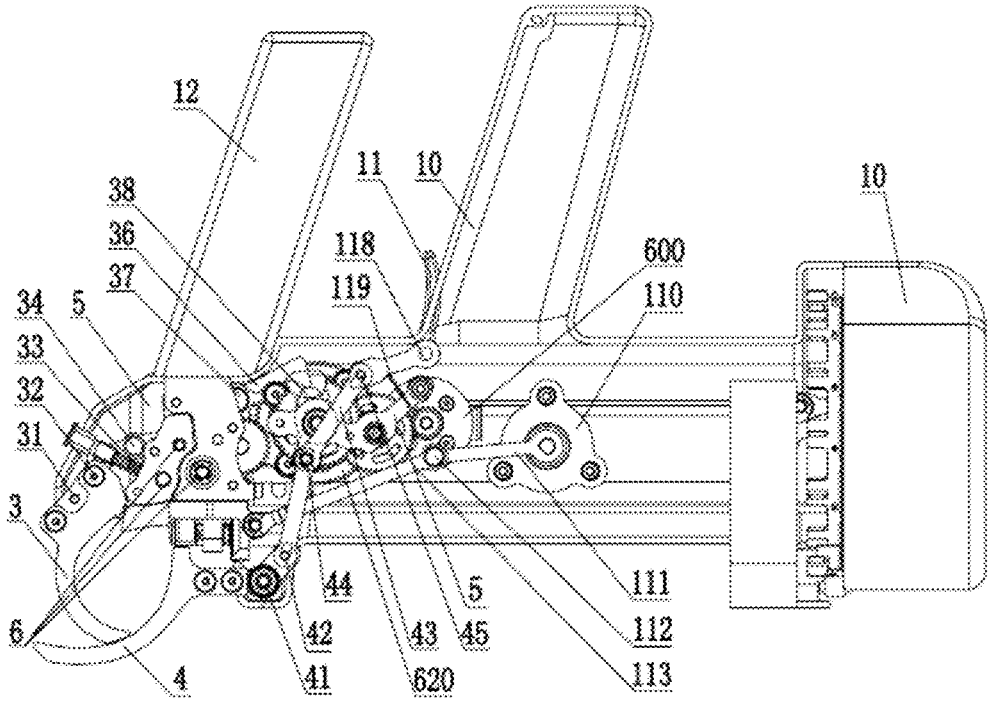
FIG. 52 is a rear view with reference to FIG. 34, with the shell being removed, and showing that the second guide claw is driven to close by a trigger through a connecting rod, the slider sends the tie to a binding position, the first guide claw is driven by the cam to hook inwards, and the tensioning wheel performs the transmission by the motor.

In the present embodiment, FIG. 50-FIG. 52 are all schematic longitudinal sectional views of the automated tying tool, and as shown in FIG. 50-FIG. 52, the trigger 11 is pivoted to the frame 5 through the trigger center shaft 118, the trigger 11, provided in an L shape, includes a pulling portion extending out of the frame 5 and a connecting portion located inside the frame 5, and specifically, one end of the connecting rod of second guide claw 43 is provided with a strip-shaped hole, the pin shaft 45 is inserted into the strip-shaped hole, and the pin shaft 45 is fastened to one end of the trigger 11, wherein the middle part of the connecting rod of second guide claw 43 is pivoted to the frame 5 through a center shaft of connecting rod 44, the other end of the connecting rod of second guide claw 43 is also provided with a strip-shaped hole, and a pin shaft 42 is inserted into the strip-shaped hole, and wherein the pin shaft 42 is fixedly provided at an end portion of the second guide claw 4, the second guide claw 4 is arranged in a W shape, the second guide claw 4 is sleeved on the center shaft of second guide claw 41, and the center shaft of second guide claw 41 is fixedly mounted on the frame 5.

Please continue to refer to FIG. 50-FIG. 52, the principle of closing the second guide claw 4 with respect to the first guide claw 3 using the trigger 11 is as follows: the pulling portion of the trigger 11 is pulled so that the trigger 11 rotates around the trigger center shaft 118, and in the rotating process of the trigger 11, a connecting portion thereof drives, through the pin shaft 45, the connecting rod of second guide claw 43 to rotate anticlockwise around the center shaft of connecting rod 44, and further, the connecting rod of second guide claw 43 drives, through the pin shaft 42, the second guide claw 4 to rotate clockwise around the center shaft of second guide claw 41, so as to close relative to the first guide claw 3.

Figure 47:
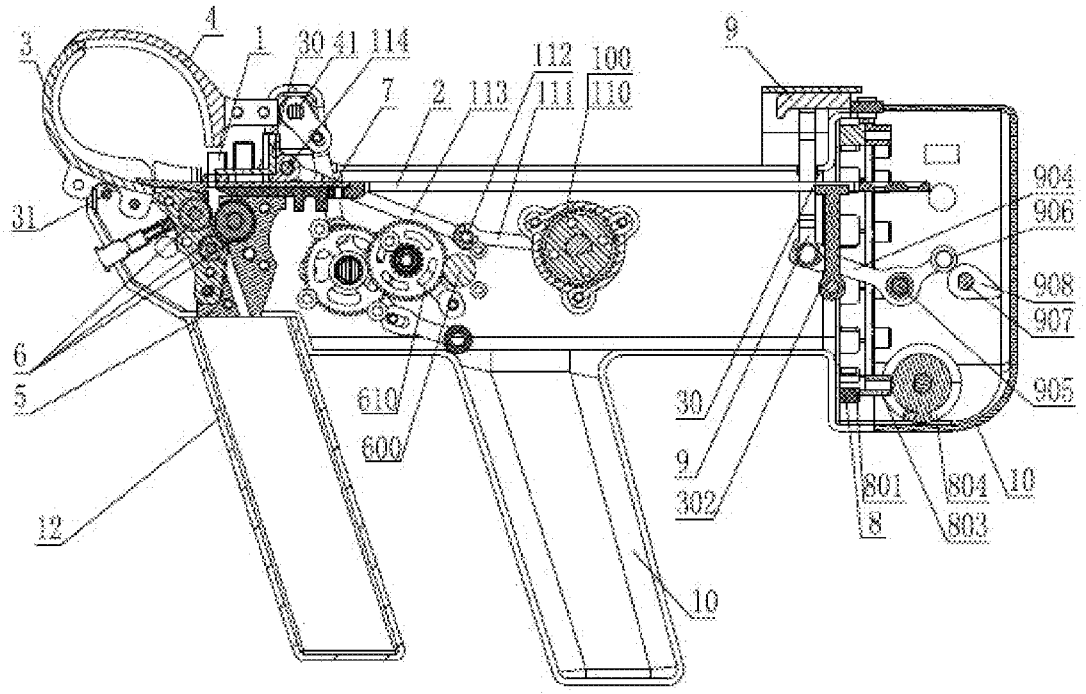
FIG. 47 is a sectional view taken along line T-T corresponding to FIG. 35, wherein the second guide claw is closed, and the slider (together with the tie) is sent to a binding operation position.
Figure 48:
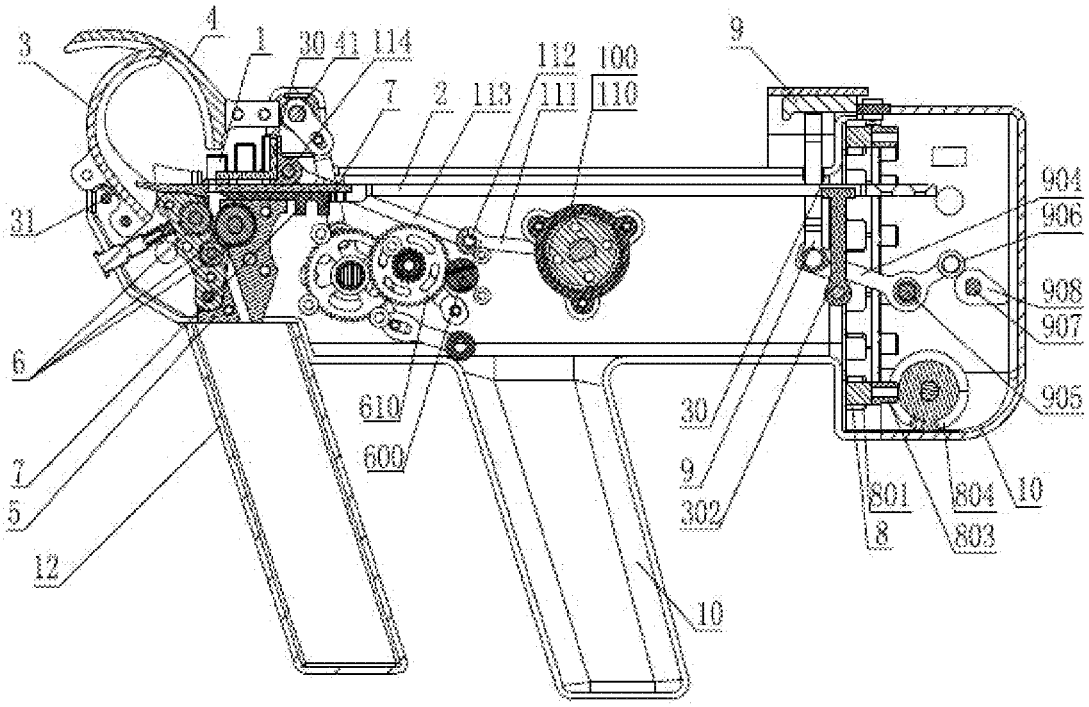
FIG. 48 is a sectional view taken along line T-T corresponding to FIG. 35, wherein the first guide claw swings inwards to insert a tail portion of the tie into a hole on a head portion of the tie.
Figure 49:
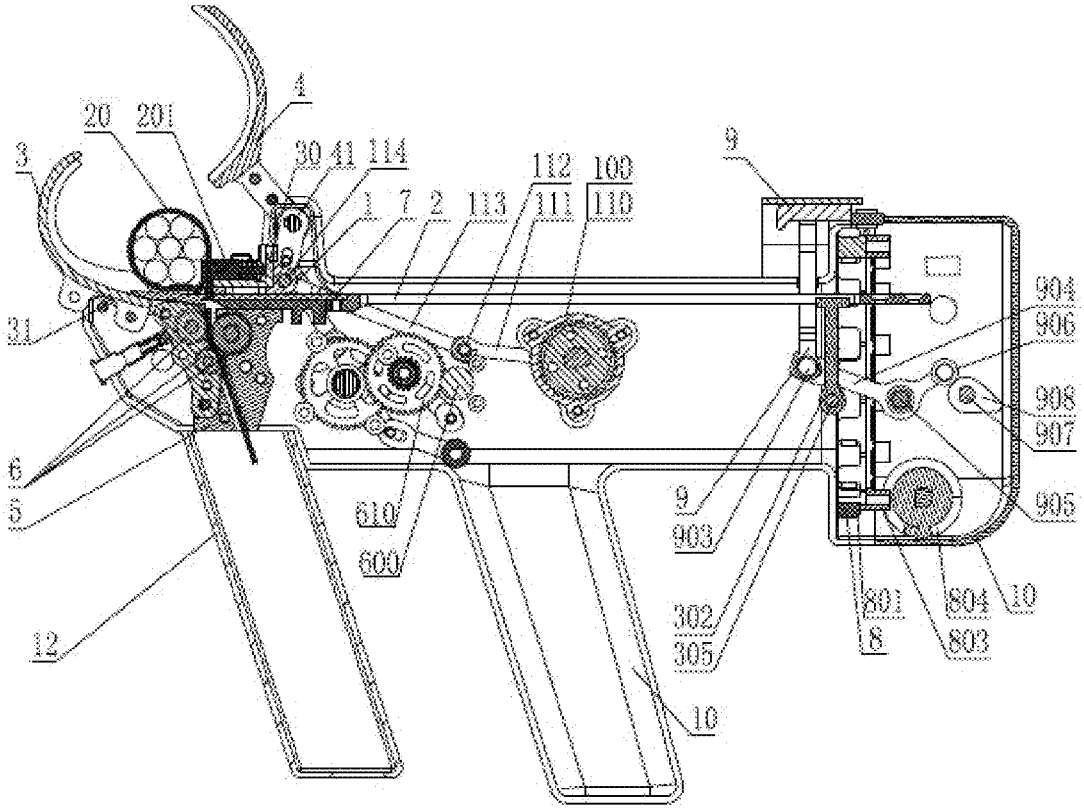
FIG. 49 is a sectional view taken along line T-T corresponding to FIG. 35, wherein the tensioning wheel driven by a motor tightens the tie, the cutter driven by the motor cuts off the tie, and the second guide claw is opened to allow the head portion of the tie to exit from the slider.

FIG. 45-FIG. 49 show the automatic binding structure of the automated tying tool. As shown in FIG. 45-FIG. 49, in the present embodiment, FIG. 45, FIG. 47, FIG. 48 and FIG. 49 are all sectional views taken along line T-T of FIG. 35, wherein in FIG. 45, the second guide claw 4 is in an open state, and at this time, the tie 20 is positioned inside the slider 1 and located in a pre-positioning position. A binding process thereof is as follows: as shown in FIG. 47, the trigger 11 is pulled to enable the second guide claw 4 and the first guide claw 3 to close, the slider 1 drives the tie 20 to slide from a right end to a left end of the guide rail 2, that is, to slide from the pre-positioning position to a binding operation position. In the sliding process of the slider 1, the tie body of the tie 20 is curled in the guide slots in the first guide claw 3 and the second guide claw 4; as shown in FIG. 48, the first guide claw 3 driven by the motor 600 rotates around a center shaft of the first guide claw 31 to pass the tail portion of the tie 20 through the hole on the head portion of tie 201, the tensioning wheel 6 driven by the motor 600 rotates to tighten the tie 20, the cutter 7 driven by the motor 600 cuts off the tightened tie 20, then completing the binding; as shown in FIG. 49, after the binding is completed, the second guide claw 4 is opened, after the head portion of tie 201 exits from the slider 1, the motor 100 drives the swinging arm 111 to rotate clockwise, the swinging arm 111 drives the connecting rod 113 through the pin shaft 112, the connecting rod 113 drives the slider 1 through the pin shaft 114 to retract back to the pre-positioning position of the tie to prepare for next binding cycle.

Please continue to refer to FIG. 36, FIG. 50, FIG. 51 and FIG. 52, in FIG. 36, the motor 600 drives a period control gear 620 through the reduction gearbox 610, the period control gear 620 drives the tensioning gear 630, the period control gear 620 has a sensing portion 621 thereon, a sensor 622 is arranged on an end surface of the period control gear 620, the sensor 622 sends a signal when detecting the sensing portion 621, so that the motor 600 stops running, and the period control gear 620 rotates by one circle in each binding tensioning cycle; the cam of the first guide claw 38 is coaxially and fixedly connected with the period control gear 620, as shown in FIG. 50-FIG. 52, the cam of the first guide claw 38 drives a driven connecting rod 36 to rotate anticlockwise around a center shaft of driven connecting rod 37, the driven connecting rod 36 drives the connecting rod 33 through the pin shaft 35 to rotate clockwise around the center shaft of connecting rod 34, the connecting rod 33 drives the first guide claw 3 through the pin shaft 32 to rotate anticlockwise around the center shaft of the first guide claw 31, and the first guide claw 3 rotates anticlockwise around the center shaft of the first guide claw 31 so that the tail portion of the tie passes through the hole on the head portion of the tie. In the present embodiment, the first guide claw 3 and the second guide claw 4 are both reset by spring.

It should be indicated that in the present embodiment, when the sensor 622 is a magnetic induction sensor, the sensing portion 621 can be provided as a magnet matched with the sensor; when the sensor 622 is a proximity sensor, the sensing portion 621 can be provided as a protrusion matched therewith; and when the sensor 622 is a photoelectric sensor, the sensing portion 621 may be a hole matched therewith.

Figure 53:
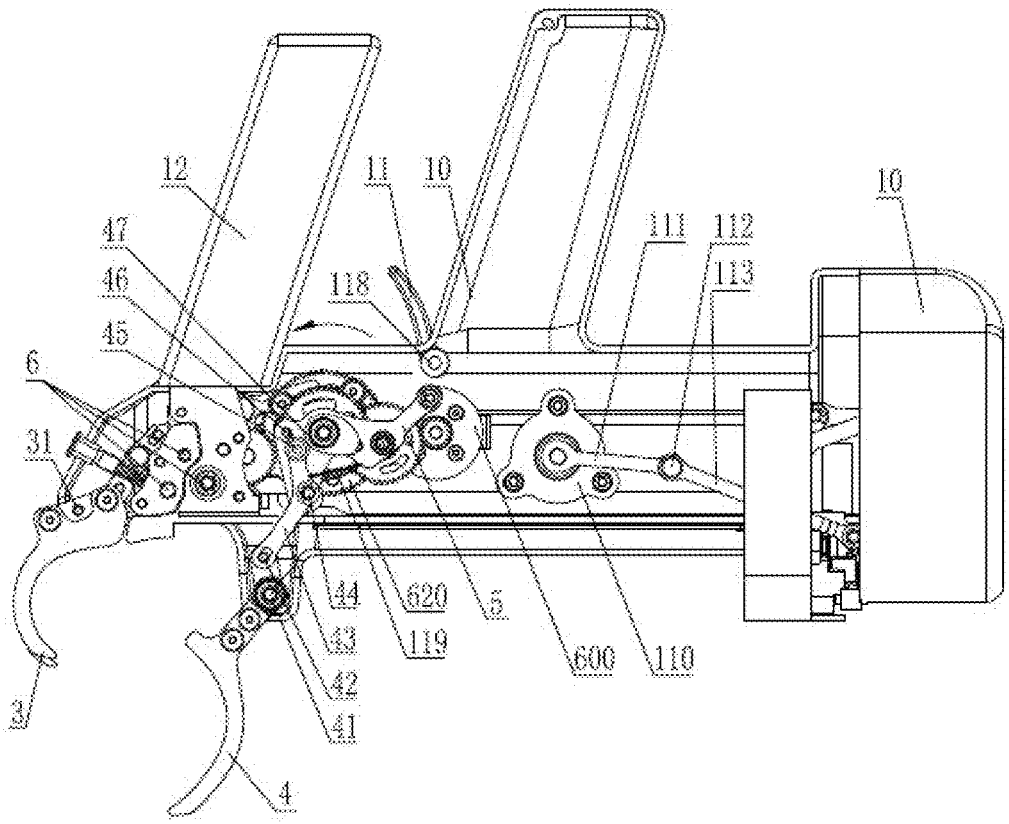
FIG. 53 is a rear view with reference to FIG. 34, with the shell being removed, and showing that the second guide claw is driven by a cam, the second guide claw is in an open state, and the slider is located in a pre-positioning position of the tie.
Figure 54:
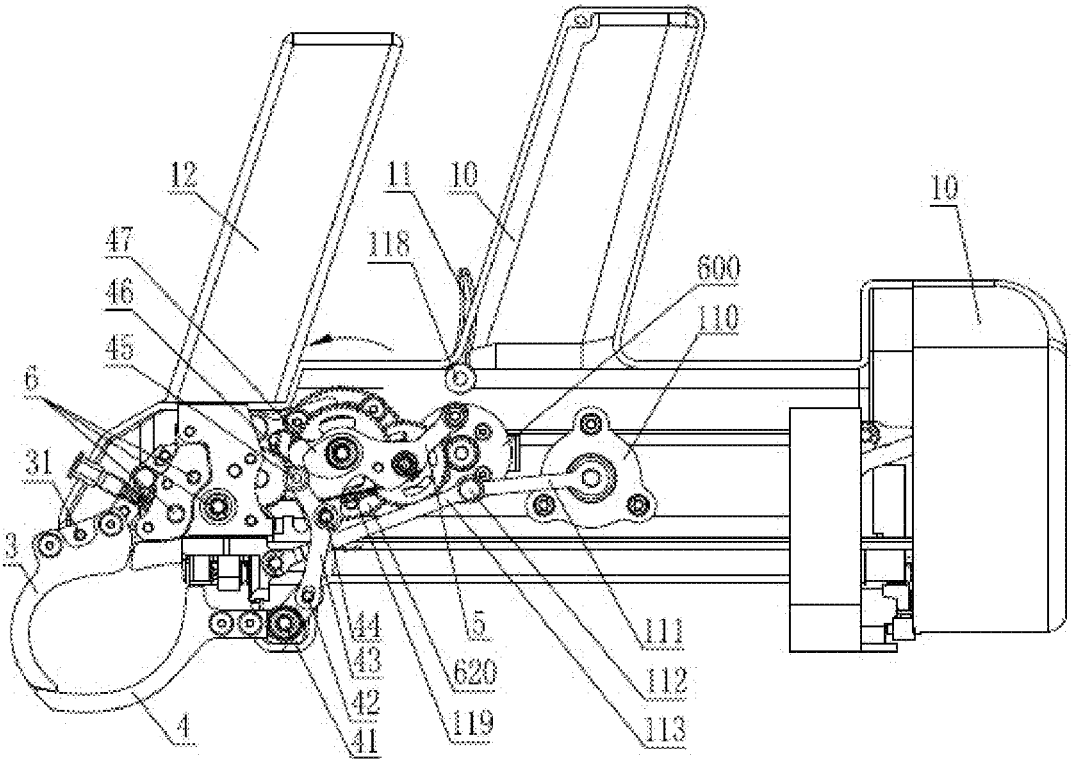
FIG. 54 is a rear view with reference to FIG. 34, with the shell being removed, and showing that the second guide claw is driven by a cam, the second guide claw is in a closed state, and the slider sends the tie to a binding position.

Please continue to refer to FIG. 53 and FIG. 54, in the present embodiment, the trigger 11 is replaced by the cam of second guide claw 47, which drives the second guide claw 4, the cam of second guide claw 47 is coaxially and fixedly connected with the period control gear 620, the cam of second guide claw 47 rotates in an anticlockwise direction (directions of arrows shown in FIG. 53 and FIG. 54), the cam of second guide claw 47 drives the roller 46, and the roller 46 is sleeved on the pin shaft 45, the pin shaft 45 is fastened on the connecting rod of second guide claw 43, the center shaft of connecting rod 44 is fastened on the frame 5, the roller 46 drives the connecting rod of second guide claw 43 to perform anticlockwise rotation around the center shaft of connecting rod 44, and the connecting rod of second guide claw 43 drives the second guide claw 4, through the pin shaft 42, to rotate clockwise around the center shaft of second guide claw 41 to be closed with the first guide claw 3. The reset spring 119 enables the second guide claw 4 to reset, and a trigger reset spring 117 (shown in FIG. 12-FIG. 17) enables the trigger 11 to reset.

Figure 55:
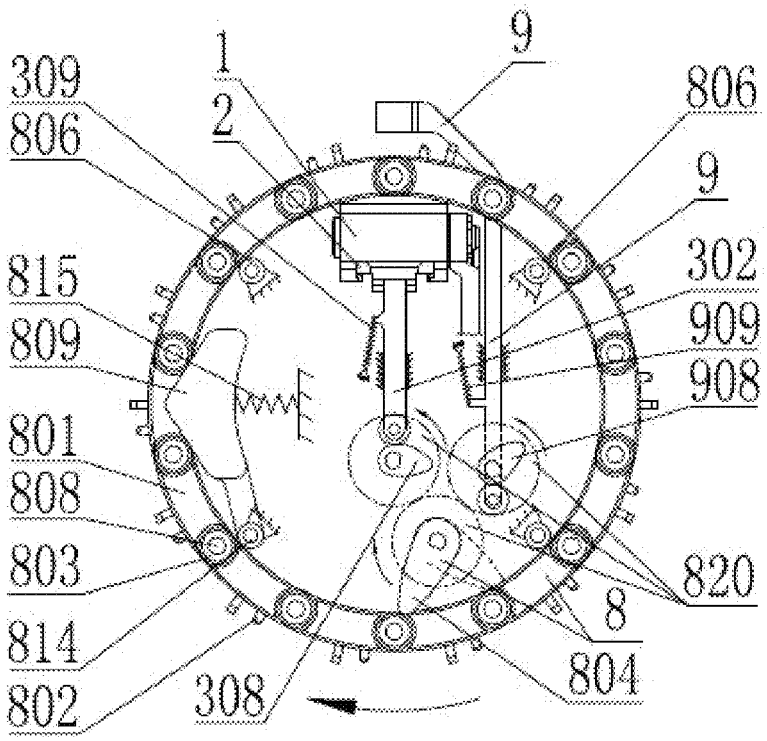
FIG. 55 shows an alternative solution of an intermittent indexing mechanism shown in FIG. 37 and FIG. 41, wherein the cam stirs an interval roller, and a locking block locks the wheel disc.

As shown in FIG. 55, in the present embodiment, an alternative solution to the mechanism for driving the wheel disc 801 is mainly displayed, and in FIG. 55, the indexing cam (single acting) 804 acts on the interval roller 803, a locking block 809 is sleeved on a pin shaft 814 and can swing around the pin shaft 814, the pin shaft 814 is fastened on the frame 5, two inclined surfaces of the locking block 809 abut against outer circumferential surfaces of two adjacent interval rollers 803 under thrust of a spring 815, each turn of the cam 804 leads to the rotation of an interval pin 808 of the wheel disc 801 by one indexing interval, the locking block 809 locks the wheel disc after preforming indexing. When the wheel disc 801 is in a locked state, the indexing cam 804 continues to rotate, sequentially, the rising edge of the cam 308 acts to lift the ejector pin of riving knife 302, a reset spring of ejector pin of riving knife 309 hooks on the ejector pin of riving knife 302, the reset spring of ejector pin of riving knife 309 pulls the ejector pin of riving knife 302 downwards to reset, when or after a vertex of the cam 308 pushes the ejector pin of riving knife 302 to a highest point, the rising edge of the cam 908 starts to act to enable the material pushing rod 9 to move downwards, the reset spring of material pushing rod 909 hooks on the material pushing rod 9, and the reset spring of material pushing rod 909 enables the material pushing rod 9 to move upwards to reset; and the structure shown in FIG. 55 have a similar working principle to a ratchet and a pawl.

Figure 56:
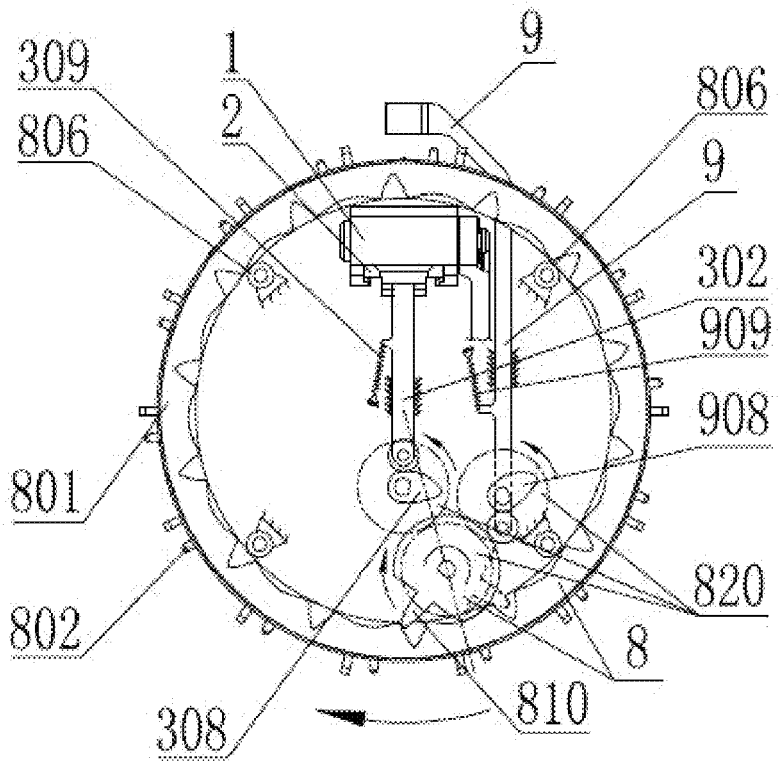
FIG. 56 shows an alternative solution of the intermittent indexing mechanism shown in FIG. 37 and FIG. 41, wherein the wheel disc is driven or locked by an incomplete gear.

As shown in FIG. 56, an incomplete gear 810 is used to replace the cam for engagement to drive the wheel disc 801 to perform the intermittent indexing motion, wherein there is only one tooth and an outer convex arc on circumference of the incomplete gear 810, the wheel disc 801 is provided with a plurality of inner tooth profiles which are uniformly distributed and can be engaged with the tooth of the incomplete gear 810, the wheel disc 801 is also provided with a plurality of inner concave arcs which are uniformly distributed and can be matched with the outer convex arc of the incomplete gear 810, when the tooth of the incomplete gear 810 is engaged with the inner tooth profiles on the wheel disc 801, the outer convex arc of the incomplete gear 810 is out of contact with the inner concave arc of the wheel disc 801, the wheel disc 801 is in an indexing motion state, when the tooth of the incomplete gear 810 is disengaged from the inner tooth profiles on the wheel disc 801, the outer convex arc of the incomplete gear 810 keeps in contact with the inner concave arc of the wheel disc 801, the wheel disc 801 is in an indexing locked state, the incomplete gear 810 continues to rotate, and sequentially, the rising edge of the cam 308 acts to enable the ejector pin of riving knife 302 to rise, the rising edge of the cam 908 acts to enable the material pushing rod 9 to move downwards; the incomplete gear 810 can also be arranged outside the circumference of the wheel disc 801, and when the incomplete gear 810 is arranged outside the circumference of the wheel disc 801, the working principle of the incomplete gear is similar to that of a geneva mechanism; or, a geneva mechanism is used to replace the incomplete gear mechanism formed by combining the above incomplete gear 810 and the wheel disc 801, namely, the wheel disc 801 is provided with uniformly distributed radial grooves and uniformly distributed inner concave arcs, a driving disc is additionally arranged to replace the incomplete gear 810, a shifting pin and an outer convex arc are arranged on the driving disc, the shifting pin on the driving disc is engaged with the groove of the wheel disc 801 to drive the wheel disc 801 to rotate, and when the outer convex arc on the driving disc is matched with the inner concave arc of the wheel disc 801, the wheel disc is locked, so that the intermittent indexing motion of the wheel disc is realized.

Such form of using the incomplete gear 810 or the single acting indexing cam 804, as shown in FIG. 55 and FIG. 56, to realize indexing feeding for the wheel disc 801 reduces the manufacturing difficulty of the indexing mechanism, thereby reducing the manufacturing cost of the automated tying tool, and further, by providing the incomplete gear 810 or the indexing cam 804 inside the wheel disc 801, the external space is greatly saved, and thus the degree of compactness of the automated tying tool is improved.

Figure 57:
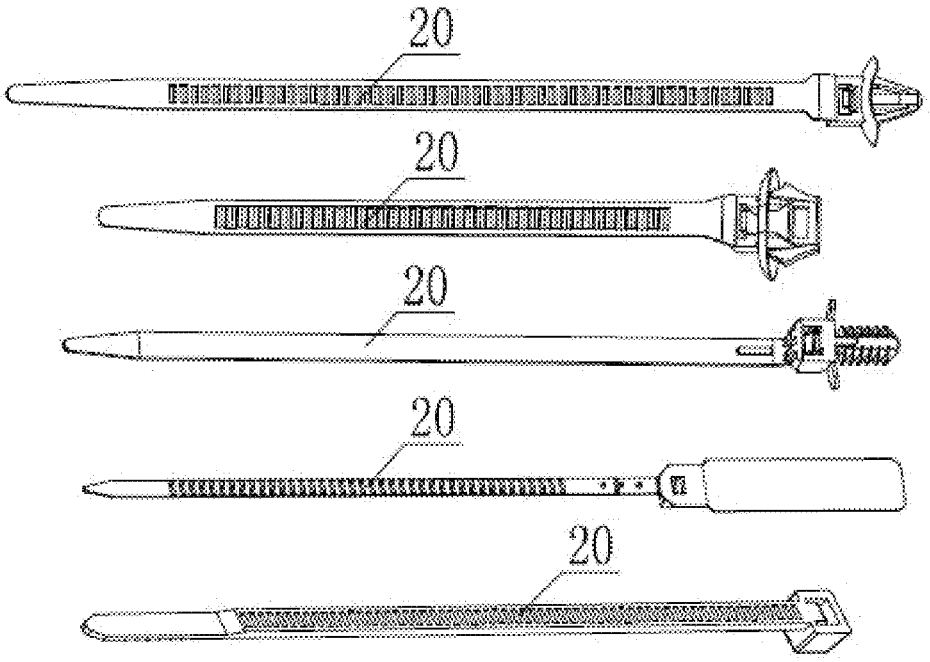
FIG. 57 is an isometric diagram showing one-piece fixing ties with irregular head shapes such as aircraft head, mushroom head, and fir-tree head, a tie with a label, and a common tie with regular head shape.

Please continue to refer to FIG. 57, in the present embodiment, one-piece fixing ties with irregular head shapes such as aircraft head, mushroom head, and fir-tree head, a tie with a label, and a common tie with regular head shape are shown (in the figure, the tie 20 at the bottom is a common tie with regular head shape), and as long as the protruding ribs 104 are reasonably arranged on the slider 1 or the riving knife 30, or on both the slider 1 and the riving knife 30 according to the specific head shape of the tie, the present disclosure can realize automatic binding for the interconnected ties with various irregular head shapes, the ties with a label, or common ties with regular head shape.

Please continue to refer to FIG. 33 and FIG. 36, in the present embodiment, a controller 000 of the automated tying tool is connected to an external power source through a wire 001, and the controller 000 is used to control on and off actions or start and stop of each motor or solenoid valve, or a battery and the controller 000 are both embedded in the housing 10, or a rechargeable battery is connected to the housing through a clamp or a screw and integrated with the automated tying tool, so that the automated tying tool can be used independently in high altitude or field work.

Those skilled in the art further could make appropriate variations and modifications to the above embodiments according to the disclosure and teachings of the foregoing specification. Therefore, the present disclosure is not limited to the specific embodiments disclosed and described above, and some modifications and variations of the present disclosure should also fall within the scope of protection of the claims of the present disclosure. Furthermore, although some specific terms are used in the present specification, these terms are merely for the purpose of facilitating the description, rather than constituting any limitation on the present disclosure.

INDUSTRIAL APPLICABILITY

The material feeding, separating and pushing mechanism of a tying tool, the automated tying tool and the automated tying method provided in the present disclosure realize the automatic binding of the ties, overcome the drawback of great labor intensity and low binding efficiency of the manual binding operation, moreover, the present disclosure is especially designed for automatic binding of loose-packed or interconnected ties with different head shapes or ties with a label, and the present disclosure is also applicable to the automatic binding operation of loose-packed or interconnected common ties with a regular head shape, thus having relatively high degree of universalization, and bringing great convenience to the binding operation.

What is claimed is:

1. An automated tying tool, comprising: a slider, a guide rail, a first guide claw, a second guide claw, a frame, a tensioning wheel, a cutter, a stepping feeding mechanism and a material pushing rod, wherein the first guide claw and the second guide claw are mounted on the frame via a rotation-center pin, the cutter and the tensioning wheel are mounted in the frame, the guide rail is adjacent to the frame, the slider cooperates with the guide rail and slides along a length direction of the guide rail, the first guide claw, the second guide claw, the slider and the guide rail are arranged to have symmetrical center planes located on a center plane of the automated tying tool, the stepping feeding mechanism is mounted on the frame or mounted on a housing of the automated tying tool, the stepping feeding mechanism is capable of loading a tie, and the tie is conveyed, in each binding cycle, according to a fixed interval, to a position where a symmetrical center plane of the tie is coincident with a center plane of the automated tying tool, the material pushing rod is mounted on the frame or the housing of the automated tying tool, the material pushing rod pushes, in a direction on the center plane of the automated tying tool perpendicular to the length direction of the guide rail, the tie located on the center plane of the automated tying tool to the slider to be pre-positioned, and the slider drives the tie to slide from the pre-positioning position to a binding operation position; and wherein the slider is provided thereon with a protruding rib configured to clamp a head portion of the tie, or a profiling recess matching in shape with the head portion of the tie and to clamp the head portion of the tie.

2. The automated tying tool according to claim 1, wherein the stepping feeding mechanism comprises a wheel disc performing an intermittent indexing motion, which is configured to rotate the tie for indexing feeding; alternatively, the stepping feeding mechanism comprises a material shifting pin stepping translationally, which is configured to enable the tie to step translationally; and alternatively, the stepping feeding mechanism comprises a material shifting pin swinging back and forth, which is configured to enable the tie to swing for stepping transportation, wherein all of the wheel disc performing an intermittent indexing motion, the material shifting pin stepping translationally and the material shifting pin swinging back and forth are capable of conveying, in each binding cycle, one tie to the position where the symmetrical center plane of the tie is coincident with the center plane of the automated tying tool.

3. The automated tying tool according to claim 2, wherein profiling recesses matching, in shape, with a head portion of the tie are provided on outer circumference of the wheel disc, a plurality of the profiling recesses are provided, and all of the profiling recesses are uniformly distributed on the outer circumference of the wheel disc according to a fixed interval.

4. The automated tying tool according to claim 2, wherein the slider and the guide rail are both located inside the circumference of the wheel disc, and the material pushing rod is mounted outside the circumference of the wheel disc, and configured to push the tie towards the slider in a direction approaching to a center of the wheel disc;

alternatively, the slider and the guide rail are both located outside the circumference of the wheel disc, and the material pushing rod is mounted inside the circumference of the wheel disc, and configured to push the tie towards the slider in a direction away from the center of the wheel disc.

5. The automated tying tool according to claim 2, wherein the tie is formed of interconnected ties, the automated tying tool further comprises a riving knife configured to separate each tie among the interconnected ties from a tie connecting plate of the interconnected ties, wherein the riving knife is mounted on the slider, or the riving knife is mounted on the material pushing rod; and the riving knife is provided with a protruding rib.

6. The automated tying tool according to claim 5, wherein the riving knife is driven by pneumatic power or electric power.

7. The automated tying tool according to claim 6, wherein the tie is formed of the interconnected ties, the wheel disc is provided with a positioning column, the tie connecting plate of the interconnected ties is provided with a positioning hole, and the positioning hole cooperates with the positioning column; alternatively, the wheel disc is provided with a positioning hole, the tie connecting plate of the interconnected ties is provided with a positioning column, and the positioning column cooperates with the positioning hole.

8. The automated tying tool according to claim 6, wherein the stepping feeding mechanism comprises a material shifting pin swinging back and forth, the stepping feeding mechanism further comprises a material guiding plate, a swinging bracket and a cylinder of material shifting pin, the material guiding plate is fixedly provided on the frame, and configured to guide the interconnected ties, the swinging bracket is pivoted to the frame, and is capable of swinging back and forth along a material guiding direction, the cylinder of material shifting pin is mounted on the swinging bracket, and the material shifting pin is fixedly provided to a power output end of the cylinder of material shifting pin; and the swinging bracket is configured to swing by one fixed interval, and the cylinder of material shifting pin is configured to insert the material shifting pin into a positioning hole on the tie connecting plate of the interconnected ties, so as to drive the interconnected ties to swing for feeding.

9. The automated tying tool according to claim 2, wherein the wheel disc is provided with a plurality of the interval pins, all of the interval pins are uniformly distributed along a circumferential direction of the wheel disc at intervals, the wheel disc is further pivoted with an indexing cam, the indexing cam has a profile abutting against an outer circumferential surface of the interval pins, and the indexing cam is configured to drive the wheel disc to rotate, alternatively, the wheel disc is provided with interval pins and interval rollers sleeved on the interval pins, all of the interval pins are uniformly distributed along a circumferential direction of the wheel disc at intervals, the wheel disc is further pivoted with an indexing cam, the indexing cam has a profile abutting against an outer circumferential surface of the interval rollers, and the indexing cam is configured to drive the wheel disc to rotate or lock the wheel disc, to realize the intermittent indexing motion of the wheel disc;

alternatively, inner teeth are provided on the circumference of the wheel disc, a gear is engaged with the inner teeth of the wheel disc so as to drive or lock the wheel disc, to realize the intermittent indexing motion of the wheel disc;

alternatively, an outer tooth is provided on the circumference of the wheel disc, a gear is engaged with the outer tooth of the wheel disc so as to drive or lock the wheel disc, to realize the intermittent indexing motion of the wheel disc;

alternatively, the wheel disc is provided with a plurality of the interval pins, all of the interval pins are distributed along a circumferential direction of the wheel disc at intervals, the automated tying tool further comprises an indexing cam pivoted to the frame and a locking block elastically connected to the frame, wherein the indexing cam is configured to make the interval pins rotate for feeding, and the locking block tends to be clamped between two adjacent interval pins all the time, so as to lock the wheel disc;

alternatively, ratchets are uniformly distributed on the circumference of the wheel disc, a pawl is provided to drive the wheel disc to rotate, and a locking block is provided to lock the wheel disc, to realize the intermittent indexing motion of the wheel disc;

alternatively, incomplete tooth profiles and inner concave arcs that are uniformly distributed are provided alternately on the circumference of the wheel disc, teeth of an incomplete gear are provided to be engaged with the incomplete tooth profiles of the wheel disc to drive the wheel disc to rotate, outer convex arcs of the incomplete gear cooperates with the inner concave arcs of the wheel disc to lock the wheel disc, to realize the intermittent indexing motion of the wheel disc; and alternatively, radial grooves and inner concave arcs that are uniformly distributed are provided alternately on the wheel disc, a driving disc is arranged, shifting pins and outer convex arcs are mounted on the driving disc, the shifting pins on the driving disc are engaged with the grooves of the wheel disc to drive the wheel disc to rotate, and the outer convex arcs on the driving disc cooperates with the inner concave arcs of the wheel disc to lock the wheel disc, to realize the intermittent indexing motion of the wheel disc.

10. The automated tying tool according to claim 2, wherein the stepping feeding mechanism comprises a material shifting pin stepping translationally, the stepping feeding mechanism further comprises a material guiding plate, a feeding cylinder and a cylinder of material shifting pin, wherein the material guiding plate is fixedly provided on the frame, and configured to guide the interconnected ties, the feeding cylinder is mounted on the frame, the cylinder of material shifting pin is mounted at a power output end of the feeding cylinder, and the material shifting pin is fixedly provided at a power output end of the cylinder of material shifting pin;

the feeding cylinder is configured to linearly advance the cylinder of material shifting pin by one fixed interval, and the cylinder of material shifting pin is configured to insert the material shifting pin into a positioning hole on the tie connecting plate of the interconnected ties, so as to drive the interconnected ties to step translationally.

11. The automated tying tool according to claim 10, further comprising a material pressing assembly configured to press the tie connecting plate on the material guiding plate; and the material pressing assembly is mounted on the frame.

12. The automated tying tool according to claim 11, wherein the material pressing assembly comprises a material pressing plate and a material pressing wheel pivoted to the material pressing plate, a spring is connected between the material pressing plate and the frame, and under an action of the spring, the material pressing wheel presses the tie connecting plate on the material guiding plate, or the material pressing wheel presses the tie connecting plate on the wheel disc.

13. An automated tying method, using the automated tying tool according to claim 2 to bind the interconnected ties, comprising following steps:

S10: placing a tie on the stepping feeding mechanism, which acts to convey the tie to a position where a symmetrical center plane of the tie is coincident with a center plane of the automated tying tool;

S20: enabling a riving knife to act to separate from a tie connecting plate of the interconnected ties the tie moved in place in the step S10;

S30: enabling the material pushing rod to act to push the tie, which is separated from the tie connecting plate in the step S20, to the slider to be pre-positioned;

S40: enabling the slider to move to drive the tie to slide from a pre-positioning position in the step S30 to a binding operation position, wherein in sliding process of the slider, a tie body of the tie is curled in the guide slots in the first guide claw and the second guide claw, and enabling the first guide claw to rotate to make a tail portion of the tie pass through a hole on a head portion of the tie;

S50: enabling the tensioning wheel to rotate to tighten the tie, and cutting off a tensioned tie with the cutter; and S60: allowing the head portion of the tie to exit from the slider, wherein the slider returns back along the guide rail from the binding operation position to the pre-positioning position.

14. The automated tying tool according to claim 1, wherein the slider cooperates with the guide rail, and the guide rail is configured to restrict the slider in terms of five spatial degrees of freedom, so that the slider is only capable of sliding on the guide rail.

15. The automated tying tool according to claim 1, wherein the stepping feeding mechanism, the first guide claw, the slider, the material pushing rod and the cutter are driven by pneumatic power or electric power.

16. The automated tying tool according to claim 1, wherein the second guide claw is driven by pneumatic power or electric power, or driven by a manual trigger through a connecting rod.

17. The automated tying tool according to claim 1, further comprising a waste box mounted on the frame, wherein the waste box is configured to collect cut waste.

18. The automated tying tool according to claim 17, wherein a discharging port is provided at a bottom portion of the waste box, a door panel of waste box is arranged at the discharging port, and the door panel of waste box is pivoted to a box body of the waste box through a rotating shaft of door panel.

19. An automated tying method, using the automated tying tool according to claim 1 to bind loose-packed ties, comprising following steps:

S1: placing a tie on the stepping feeding mechanism, which acts to convey the tie to a position where a symmetrical center plane of the tie is coincident with a center plane of the automated tying tool;

S2: enabling the material pushing rod to act to push the tie to the slider to be pre-positioned;

S3: enabling the slider to move to drive the tie to slide from a pre-positioning position in the step S2 to a binding operation position, wherein in a sliding process of the slider, a tie body of the tie is curled in the guide slots in the first guide claw and the second guide claw, and enabling the first guide claw to rotate to make a tail portion of the tie pass through a hole on a head portion of the tie;

S4: enabling the tensioning wheel to rotate to tighten the tie, and cutting off a tensioned tie with the cutter; and S5: allowing the head portion of the tie to exit from the slider, wherein the slider returns back along the guide rail from the binding operation position to the pre-positioning position.

* * * * *